US011415345B2

(12) United States Patent
Yajima

(10) Patent No.: US 11,415,345 B2
(45) Date of Patent: Aug. 16, 2022

(54) REFRIGERATION APPARATUS

(71) Applicant: DAIKIN INDUSTRIES, LTD., Osaka (JP)

(72) Inventor: Ryuzaburo Yajima, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 54 days.

(21) Appl. No.: 16/755,437

(22) PCT Filed: Oct. 3, 2018

(86) PCT No.: PCT/JP2018/036998

§ 371 (c)(1),
(2) Date: Apr. 10, 2020

(87) PCT Pub. No.: WO2019/073870

PCT Pub. Date: Apr. 18, 2019

(65) Prior Publication Data

US 2020/0240686 A1 Jul. 30, 2020

(30) Foreign Application Priority Data

Oct. 12, 2017 (JP) ..... JP2017-198232

(51) Int. Cl.
*F25B 13/00* (2006.01)
*F25B 41/20* (2021.01)
*F25B 41/24* (2021.01)

(52) U.S. Cl.
CPC ..... *F25B 13/00* (2013.01); *F25B 41/20* (2021.01); *F25B 41/24* (2021.01); *F25B 2600/2501* (2013.01)

(58) Field of Classification Search
CPC ..... F25B 41/20; F25B 41/24; F25B 13/00; F25B 2600/25–2600/2525
See application file for complete search history.

(56) References Cited

U.S. PATENT DOCUMENTS 10,655,900 B2 * 5/2020 Tanaka ..... F25B 13/00
10,670,282 B2 * 6/2020 Yamada ..... F25B 41/31
(Continued)

FOREIGN PATENT DOCUMENTS

CN 104613685 A 5/2015
CN 106440545 A 2/2017
(Continued)

OTHER PUBLICATIONS

International Search Report (PCT/ISA/210) issued in PCT/JP2018/036998, dated Dec. 25, 2018.

*Primary Examiner* — Miguel A Diaz
(74) *Attorney, Agent, or Firm* — Birch, Stewart, Kolasch & Birch, LLP

(57) ABSTRACT

An outdoor expansion valve is provided for a liquid side pipe of an outdoor circuit. The outdoor circuit is provided with a liquid side bypass pipe that allows the liquid side pipe to communicate with a suction side of a compressor. Receiving a signal indicating that a refrigerant has leaked from an indoor circuit, an outdoor controller executes a refrigerant recovery control operation of operating the compressor with a liquid side control valve closed, and executes a valve control operation of opening a liquid side bypass valve of the liquid side bypass pipe in the refrigerant recovery control operation. As a result, the refrigerant can be recovered from an utilization-side circuit to a heat-source-side circuit while avoiding damage to the compressor, and the amount of refrigerant leaking from the utilization-side circuit can be reduced.

10 Claims, 7 Drawing Sheets

(56) References Cited

U.S. PATENT DOCUMENTS

| | | | | |
|---|---|---|---|---|
| 2008/0282728 | A1* | 11/2008 | Takegami | F25B 13/00 62/498 |
| 2009/0255284 | A1* | 10/2009 | Yoshimi | F24F 3/065 62/149 |
| 2011/0083456 | A1* | 4/2011 | Wakamoto | F25B 41/00 62/115 |
| 2015/0143841 | A1* | 5/2015 | Kawano | F25B 1/005 62/498 |
| 2016/0238297 | A1* | 8/2016 | Nuno | F25B 47/025 |
| 2017/0010030 | A1* | 1/2017 | Tanaka | F25B 13/00 |
| 2018/0283751 | A1* | 10/2018 | Song | F25B 49/02 |
| 2019/0331375 | A1* | 10/2019 | Tanaka | F25B 47/02 |
| 2019/0338986 | A1* | 11/2019 | Yamada | F24F 3/0525 |
| 2020/0011580 | A1* | 1/2020 | Matsuda | F25B 13/00 |
| 2020/0158352 | A1* | 5/2020 | Sanada | F24F 1/00075 |
| 2020/0166257 | A1* | 5/2020 | Wada | F25B 49/02 |
| 2020/0248943 | A1* | 8/2020 | Nishio | F25B 41/20 |

FOREIGN PATENT DOCUMENTS

| | | | | |
|---|---|---|---|---|
| EP | 3 418 655 | A1 | | 12/2018 |
| JP | 10-9692 | A | | 1/1998 |
| JP | 2013-122364 | A | | 6/2013 |
| JP | 2013122364 | A | * | 6/2013 |
| JP | 2015-209979 | A | | 11/2015 |
| JP | 2015209979 | A | * | 11/2015 |
| JP | 5975714 | B2 | | 8/2016 |
| WO | WO 2015/132959 | A1 | | 9/2015 |
| WO | WO 2017/141899 | A1 | | 9/2017 |

* cited by examiner

REFRIGERATION APPARATUS

TECHNICAL FIELD

The present invention relates to a refrigeration apparatus that circulates a refrigerant in a refrigerant circuit to perform a refrigeration cycle.

BACKGROUND ART

A refrigeration apparatus that circulates a refrigerant in a refrigerant circuit to perform a refrigeration cycle has been known in the art. Patent Document 1 discloses a separate-type air conditioner which is one of such refrigeration apparatuses.

Pipes constituting a refrigerant circuit and heat transfer tubes constituting a heat exchanger may be corroded depending on the installation condition of the refrigeration apparatus. Such corrosion may cause a hole to open in the pipe or the heat transfer tube, from which the refrigerant may leak out.

What is called chlorofluorocarbon refrigerants have been widely used as the refrigerant for the refrigeration cycle. Many chlorofluorocarbon refrigerants have a relatively high global warming potential (GWP). Therefore, from the viewpoint of reducing global warming, it is desirable to reduce the amount of such refrigerant leaking from the refrigerant circuit as much as possible.

For example, a slightly flammable material such as HFC-32 is used as the refrigerant for the refrigeration cycle in some cases. Such a slightly flammable refrigerant may ignite if it leaks into a closed space. Therefore, also from the viewpoint of safety, it is desirable to reduce the amount of such refrigerant leaking from the refrigerant circuit as much as possible.

An air conditioner described in Patent Document 1 is configured to execute an operation for reducing the amount of the refrigerant leaking from the refrigerant circuit. In an outdoor unit of the air conditioner, control valves are respectively provided for a liquid side pipe connected to a liquid side connection pipe and a gas side pipe connected to a gas side connection pipe. In response to detection of the leakage of the refrigerant into the room, the air conditioner executes a refrigerant recovery operation.

In the refrigerant recovery operation, the air conditioner performs what is called pump down to recover the refrigerant in an indoor unit to the outdoor unit. Specifically, the air conditioner sets a four-way valve to be in a state of a cooling operation, actuates a compressor with the control valve of the liquid side pipe closed, condenses in an outdoor heat exchanger the refrigerant sucked from the indoor unit and compressed by the compressor, and stores the condensed refrigerant in a receiver or the like. In response to satisfaction of a condition for terminating the pump down (e.g., a duration of the pump down reaches a predetermined value or a suction pressure of the compressor falls below a predetermined reference value), the air conditioner closes the control valve of the gas side pipe to stop the compressor. As a result, the refrigerant in the indoor unit is recovered to and sealed in the outdoor unit.

CITATION LIST

Patent Documents

Patent Document 1: Japanese Unexamined Patent Publication No. H10-009692

SUMMARY OF THE INVENTION

Technical Problem

What is called pump down is an operation of sucking the refrigerant in an utilization-side circuit into the compressor, with the flow of the refrigerant from a heat-source-side circuit to the utilization-side circuit blocked by a valve or the like. Therefore, in the pump down, the suction pressure of the compressor (i.e., the pressure of the refrigerant to be sucked into the compressor) gradually decreases, while the discharge pressure of the compressor (i.e., the pressure of the refrigerant discharged from the compressor) gradually increases. Accordingly, in the pump down, the difference between the suction pressure and discharge pressure of the compressor increases, and the discharge temperature of the compressor (i.e., the temperature of the refrigerant discharged from the compressor) gradually increases.

When the discharge temperature of the compressor reaches a certain level or more (e.g., 135° C. or more), problems arise, such as damage to the compressor itself, and deterioration of a refrigerating machine oil stored in the compressor. Therefore, in the conventional refrigeration apparatus, the condition for terminating the pump down needs to be set so that the discharge temperature of the compressor reduced to a certain level or less. If such condition is set, the pump down may end although a relatively large amount of refrigerant remains in the utilization-side circuit, and the refrigerant in the utilization-side circuit cannot be sufficiently recovered in the heat-source-side circuit.

The present invention has been made in view of the above problems, and an object of the present invention is to recover a refrigerant from an utilization-side circuit in a heat-source-side circuit while avoiding damage to a compressor, and to reliably reduce the amount of refrigerant leaking from the utilization-side circuit in case of leakage of the refrigerant.

Solution to the Problem

A first aspect of the present disclosure is directed to a refrigeration apparatus, including: a refrigerant circuit (30) that includes a heat-source-side circuit (40) provided with a compressor (41) and a heat-source-side heat exchanger (43), and an utilization-side circuit (60) provided with an utilization-side heat exchanger (61), the refrigeration apparatus being capable of executing a cooling operation of performing a refrigeration cycle in the refrigerant circuit (30) with the heat-source-side heat exchanger (43) serving as a radiator and the utilization-side heat exchanger (61) serving as an evaporator. The heat-source-side circuit (40) includes a liquid side control valve (44, 55) provided for a liquid side pipe (47) in which a refrigerant flows from the heat-source-side heat exchanger (43) toward the utilization-side heat exchanger (61) in the cooling operation, a liquid side bypass pipe (50) that allows a portion of the liquid side pipe (47) between the heat-source-side heat exchanger (43) and the liquid side control valve (44, 55) to communicate with a suction side of the compressor (41), and a liquid side bypass valve (51) provided for the liquid side bypass pipe (50). The refrigeration apparatus further includes a controller (80) configured to execute, upon receiving a leakage signal indicating a leakage of the refrigerant from the utilization-side circuit (60), a refrigerant recovery control operation of actuating the compressor (41) with the liquid side control valve (44, 55) closed so that the refrigerant in the utilization-side circuit (60) is recovered in the heat-source-side circuit (40). The controller (80) is configured to execute a valve control operation of opening the liquid side bypass valve (51) in the refrigerant recovery control operation.

In the first aspect, the refrigerant circuit (30) of the refrigeration apparatus (10) is provided with the heat-source-side circuit (40) and the utilization-side circuit (60). In the cooling operation of the refrigeration apparatus (10), a refrigeration cycle in which the heat-source-side heat exchanger (43) functions as a radiator and the utilization-side heat exchanger (61) functions as an evaporator is performed in the refrigerant circuit (30).

In the first aspect, the controller (80) executes the refrigerant recovery control operation upon receiving the leakage signal. The leakage signal is a signal indicating leakage of the refrigerant from the utilization-side circuit (60), and is transmitted to the controller (80) from, for example, a refrigerant sensor or the like. In the refrigerant recovery control operation of the controller (80), the liquid side control valve (44, 55) is closed, and the compressor (41) is actuated. The flow of the refrigerant from the heat-source-side circuit (40) to the utilization-side circuit (60) is blocked by the liquid side control valve (44, 55), and the refrigerant in the utilization-side circuit (60) is sucked into the compressor (41) to be recovered in the heat-source-side circuit (40).

The controller (80) of the first aspect executes the valve control operation in the refrigerant recovery control operation. In a state in which the liquid side bypass pipe (50) is opened through the valve control operation, the compressor (41) sucks the refrigerant that has flowed from the utilization-side circuit (60) into the heat-source-side circuit (40), and the refrigerant flowing through the liquid side bypass pipe (50). That is, part of the refrigerant recovered from the utilization-side circuit (60) to the heat-source-side circuit (40) is sucked into the compressor (41) through the liquid side bypass pipe (50). Sucking the refrigerant flowing through the liquid side bypass pipe (50) into the compressor (41) together with the refrigerant that has flowed from the utilization-side circuit (60) to the heat-source-side circuit (40) makes it possible to keep the suction pressure of the compressor (41) at a certain level or more. Therefore, in this aspect, the compressor (41) can continue to operate for a long period of time with the liquid side control valve (44, 55) closed.

A second aspect of the present disclosure is an embodiment of the first aspect. In the second aspect, the heat-source-side circuit (40) includes a gas side bypass pipe (52) that allows a discharge side of the compressor (41) to communicate with the suction side of the compressor (41), and a gas side bypass valve (53) provided for the gas side bypass pipe (52).

In the second aspect, the gas side bypass pipe (52) and the gas side bypass valve (53) are provided for the heat-source-side circuit (40). In a state in which the gas side bypass valve (53) is open, at least part of the refrigerant discharged from the compressor (41) is sucked again into the compressor (41) through the gas side bypass pipe (52).

A third aspect of the present disclosure is an embodiment of the first or second aspect. In the third aspect, the controller (80) is configured to execute, as the valve control operation, an operation of adjusting an opening degree of the liquid side bypass valve (51) such that the refrigerant to be sucked into the compressor (41) is in a gas single-phase state.

In the third aspect, receiving the leakage signal, the controller (80) adjusts the opening degree of the liquid side bypass valve (51) in the valve control operation executed in the refrigerant recovery control operation. The operation executed by the controller (80) keeps the refrigerant to be sucked into the compressor (41) in the gas single-phase state.

A fourth aspect of the present disclosure is an embodiment of the first or second aspect. In the fourth aspect, the controller (80) is configured to execute, as the valve control operation, an operation of adjusting an opening degree of the liquid side bypass valve (51) such that the refrigerant discharged from the compressor (41) has a degree of superheat equal to or more than a predetermined value.

In the fourth aspect, receiving the leakage signal, the controller (80) adjusts the opening degree of the liquid side bypass valve (51) in the valve control operation executed in the refrigerant recovery control operation. The operation executed by the controller (80) allows the refrigerant discharged from the compressor (41) to maintain a degree of superheat equal to or more than the predetermined value.

A fifth aspect of the present disclosure is an embodiment of the second aspect. In the fifth aspect, the liquid side bypass valve (51) is a valve whose opening degree in an open state is variable, the gas side bypass valve (53) is a valve whose opening degree in an open state is fixed, and the controller (80) is configured to execute, as the valve control operation, an operation of adjusting an opening degree of the liquid side bypass valve (51) such that the refrigerant to be sucked into the compressor (41) is in a gas single-phase state, and an operation of opening the gas side bypass valve (53).

In the fifth aspect, receiving the leakage signal, the controller (80) executes the operation of adjusting the opening degree of the liquid side bypass valve (51) and the operation of opening the gas side bypass valve (53) as the valve control operation executed in the refrigerant recovery control operation. The valve control operation executed by the controller (80) keeps the refrigerant to be sucked into the compressor (41) in the gas single-phase state.

A sixth aspect of the present disclosure is an embodiment of the second aspect. In the sixth aspect, the liquid side bypass valve (51) is a valve whose opening degree in an open state is variable, the gas side bypass valve (53) is a valve whose opening degree in an open state is fixed, and the controller (80) is configured to execute, as the valve control operation, an operation of adjusting an opening degree of the liquid side bypass valve (51) such that the refrigerant discharged from the compressor (41) has a degree of superheat equal to or more than a predetermined value, and an operation of opening the gas side bypass valve (53).

In the sixth aspect, receiving the leakage signal, the controller (80) executes the operation of adjusting the opening degree of the liquid side bypass valve (51) and the operation of opening the gas side bypass valve (53) as the valve control operation performed in the refrigerant recovery control operation. The valve control operation executed by the controller (80) allows the refrigerant discharged from the compressor (41) to maintain a degree of superheat equal to or more than the predetermined value.

A seventh aspect of the present disclosure is an embodiment of any one of the first to sixth aspects. In the seventh aspect, the controller (80) is configured to adjust, in the refrigerant recovery control operation, an operating capacity of the compressor (41) such that the refrigerant to be sucked into the compressor (41) has a predetermined target pressure higher than an atmospheric pressure.

In the seventh aspect, the controller (80) that executes the refrigerant recovery operation adjusts the operating capacity of the compressor (41) to maintain the pressure of the utilization-side circuit (60) at a target pressure higher than the atmospheric pressure. Therefore, even if the utilization-side circuit (60) is damaged, the air does not flow into the refrigerant circuit (30) from the damaged part of the utilization-side circuit (60).

An eighth aspect of the present disclosure is an embodiment of any one of the first to seventh aspects. In the eighth aspect, the heat-source-side circuit (40) has a four-way switching valve (42) that switches between a first state in which a discharge side of the compressor (41) communicates with the heat-source-side heat exchanger (43) and a suction side of the compressor (41) communicates with the utilization-side circuit (60), and a second state in which the discharge side of the compressor (41) communicates with the utilization-side circuit (60) and the suction side of the compressor (41) communicates with the heat-source-side heat exchanger (43). The controller (80) is configured to set the four-way switching valve (42) to be in the first state in the refrigerant recovery control operation. The liquid side bypass pipe (50) is connected to a pipe (48) that allows the four-way switching valve (42) to communicate with the utilization-side circuit (60).

In the eighth aspect, receiving the leakage signal, the controller (80) sets the four-way switching valve (42) to the first state in the refrigerant recovery operation. As a result, the compressor (41) sucks the refrigerant from the utilization-side circuit (60), and discharges the refrigerant to the heat-source-side heat exchanger (43). In the heat-source-side circuit (40), the liquid side bypass pipe (50) is connected to the pipe (48) that allows the four-way switching valve (42) to communicate with the utilization-side circuit (60). In a state in which the liquid side bypass pipe (51) is opened through the valve control operation executed by the controller (80) in the refrigerant recovery control operation, the refrigerant flowing through the liquid side bypass pipe (50) merges with the refrigerant that has flowed from the utilization-side circuit (60) into the pipe (48) of the heat-source-side circuit (40), and then passes through the four-way switching valve (42) to be sucked into the compressor (41). Therefore, after a certain period of time has passed since the compressor (41) was started by the refrigerant recovery control operation of the controller (80), the refrigerant in the utilization-side circuit (60) can be kept in almost the same state as the refrigerant to be sucked into the compressor (41).

A ninth aspect of the present disclosure is an embodiment of any one of the first to eighth aspects. In the ninth aspect, the heat-source-side circuit (40) has a container member (57) which is arranged in the liquid side bypass pipe (50) between the liquid side bypass valve (51) and the liquid side pipe (47) to store the refrigerant.

In the ninth aspect, the container member (57) is provided for the liquid side bypass pipe (50) of the heat-source-side circuit (40). The container member (57) stores the refrigerant recovered from the utilization-side circuit (60) to the heat-source-side circuit (40) through the refrigerant recovery control operation executed by the controller (80).

A tenth aspect of the present disclosure is an embodiment of any one of the first to ninth aspects. In the tenth aspect, the heat-source-side circuit (40) has a gas side control valve (56) provided for a pipe (48) in which the refrigerant flows from the utilization-side circuit (60) toward the compressor (41) in the cooling operation. The controller (80) is configured to close the gas side control valve (56) to stop the compressor (41) in response to satisfaction of a condition for terminating the refrigerant recovery control operation.

In the tenth aspect, the controller (80) closes the gas side control valve (56) in response to satisfaction of the condition for terminating the refrigerant recovery control operation. In this state, both of the liquid side control valve (44, 55) and the gas side control valve (56) are closed, and the heat-source-side circuit (40) and the utilization-side circuit (60) in the refrigerant circuit (30) are completely blocked from each other. The controller (80) closes the gas side control valve (56) to block the heat-source-side circuit (40) and the utilization-side circuit (60) from each other, and then stops the compressor (41). Therefore, even after the compressor (41) is stopped, the refrigerant recovered into the heat-source-side circuit (40) does not return to the utilization-side circuit (60).

Advantages of the Invention

Receiving the leakage signal, the controller (80) according to the first aspect of the present disclosure executes the refrigerant recovery control operation, and executes the valve control operation of opening the liquid side bypass valve (51) in the refrigerant recovery control operation. In a state in which the liquid side bypass valve (51) is open, the compressor (41) sucks the refrigerant that has flowed from the utilization-side circuit (60) into the heat-source-side circuit (40), and the refrigerant flowing through the liquid side bypass pipe (50). Sucking the refrigerant flowing through the liquid side bypass pipe (50) into the compressor (41) makes it possible to maintain the suction pressure of the compressor (41) at a certain level or more, and as a result, an excessive rise in the discharge temperature of the compressor (41) can be avoided.

Thus, according to the first aspect, in a state in which the liquid side control valve (44, 55) is closed by the controller (80) that has received the leakage signal, the compressor (41) can continue to operate while avoiding an excessive rise in the discharge temperature of the compressor (41), and the refrigerant in the utilization-side circuit (60) can be kept sucked into the compressor (41). Therefore, according to the first aspect, when the refrigerant has leaked from the utilization-side circuit (60), the amount of refrigerant remaining in the utilization-side circuit (60) can be sufficiently reduced, and the amount of refrigerant leaking from the utilization-side circuit (60) can be reliably reduced.

In the second aspect, the gas side bypass pipe (52) and the gas side bypass valve (53) are provided for the heat-source-side circuit (40). In response to opening of the gas side bypass valve (53), at least part of the refrigerant discharged from the compressor (41) flows into the suction side of the compressor (41). Thus, according to this aspect, opening the gas side bypass valve (53) in the refrigerant recovery control operation of the controller (80) makes it possible to control the state of the refrigerant to be sucked into the compressor (41).

In the third and fifth aspects, the controller (80) that has received the leakage signal executes the valve control operation in the refrigerant recovery control operation. This can keep the refrigerant to be sucked into the compressor (41) in the gas single-phase state.

In the refrigerant recovery operation of the controller (80), when the utilization-side circuit (60) has continued to communicate with the suction side of the compressor (41) for a certain period of time or more, the refrigerant in the utilization-side circuit (60) enters the same state as the refrigerant to be sucked into the compressor (41). Therefore, according to the third and fifth aspects, the refrigerant in the utilization-side circuit (60) can be maintained in the gas single-phase state while the controller (80) is executing the refrigerant recovery control operation, and as a result, the amount of refrigerant leaking from the utilization-side circuit (60) can be reduced as much as possible.

In the fourth and sixth aspects, the controller (80) that has received the leakage signal executes the valve control operation in the refrigerant recovery control operation. This can keep the degree of superheat of the refrigerant discharged from the compressor (41) equal to or more than a predetermined value. As a result, the wetness of the refrigerant to be sucked into the compressor (41) can be reduced to a certain level or less, which can avoid damage to the compressor (41) due to suction of the refrigerant having high wetness.

If the utilization-side circuit (60) is damaged and the air enters the refrigerant circuit (30) from the damaged part of the utilization-side circuit (60), the damaged part of the utilization-side circuit (60) needs to be repaired, and in addition, the air needs to be eliminated from the refrigerant circuit (30). This results in an increase in man-hour and cost required for the repair of the refrigeration apparatus (10).

In contrast, according to the seventh aspect, the controller (80) adjusts the operating capacity of the compressor (41) in the refrigerant recovery control operation to keep the pressure of the utilization-side circuit (60) higher than the atmospheric pressure. Thus, even if the utilization-side circuit (60) is damaged, the air can be blocked from entering the refrigerant circuit (30) from the damaged part of the utilization-side circuit (60). Therefore, according to this aspect, the man-hour and cost required for the repair of the refrigeration apparatus (10) when the utilization-side circuit (60) is damaged can be reduced.

According to the eighth aspect, the four-way switching valve (42) of the heat-source-side circuit (40) is provided, and the liquid side bypass pipe (50) is connected to the pipe (48) that allows the four-way switching valve (42) to communicate with the utilization-side circuit (60). Therefore, after a certain period of time has passed since the compressor (41) was started by the refrigerant recovery control operation of the controller (80), the refrigerant in the utilization-side circuit (60) can be kept in almost the same state as the refrigerant to be sucked into the compressor (41). This can allow only a small amount of refrigerant to remain in the utilization-side circuit (60).

In the ninth aspect, the refrigerant recovered from the utilization-side circuit (60) to the heat-source-side circuit (40) through the refrigerant recovery control operation executed by the controller (80) can be stored in the container member (57). Therefore, according to this aspect, the refrigerant recovered from the utilization-side circuit (60) can be reliably held in the heat-source-side circuit (40).

In the tenth aspect, in response to satisfaction of the condition for terminating the refrigerant recovery control operation, both of the liquid side control valve (44, 55) and the gas side control valve (56) are closed, and the heat-source-side circuit (40) and the utilization-side circuit (60) in the refrigerant circuit (30) are completely blocked from each other. Therefore, even after the compressor (41) is stopped, the refrigerant recovered into the heat-source-side circuit (40) does not return to the utilization-side circuit (60). Therefore, according to this aspect, even after the refrigerant recovery operation of the controller (80) is terminated and the compressor (41) is stopped, the amount of refrigerant remaining in the utilization-side circuit (60) can be kept small.

DESCRIPTION OF EMBODIMENTS

Embodiments of the present invention will be described in detail with reference to the drawings. Note that the following embodiments and variations are merely beneficial examples in nature, and are not intended to limit the scope, applications, or use of the present invention. The following embodiments and variations may be combined and replaced with each other without deteriorating functions of an air conditioner or a refrigerator.

First Embodiment

A first embodiment will be described below. This embodiment is directed to an air conditioner (10) including a refrigeration apparatus.

—Configuration of Air Conditioner—

Figure 1:
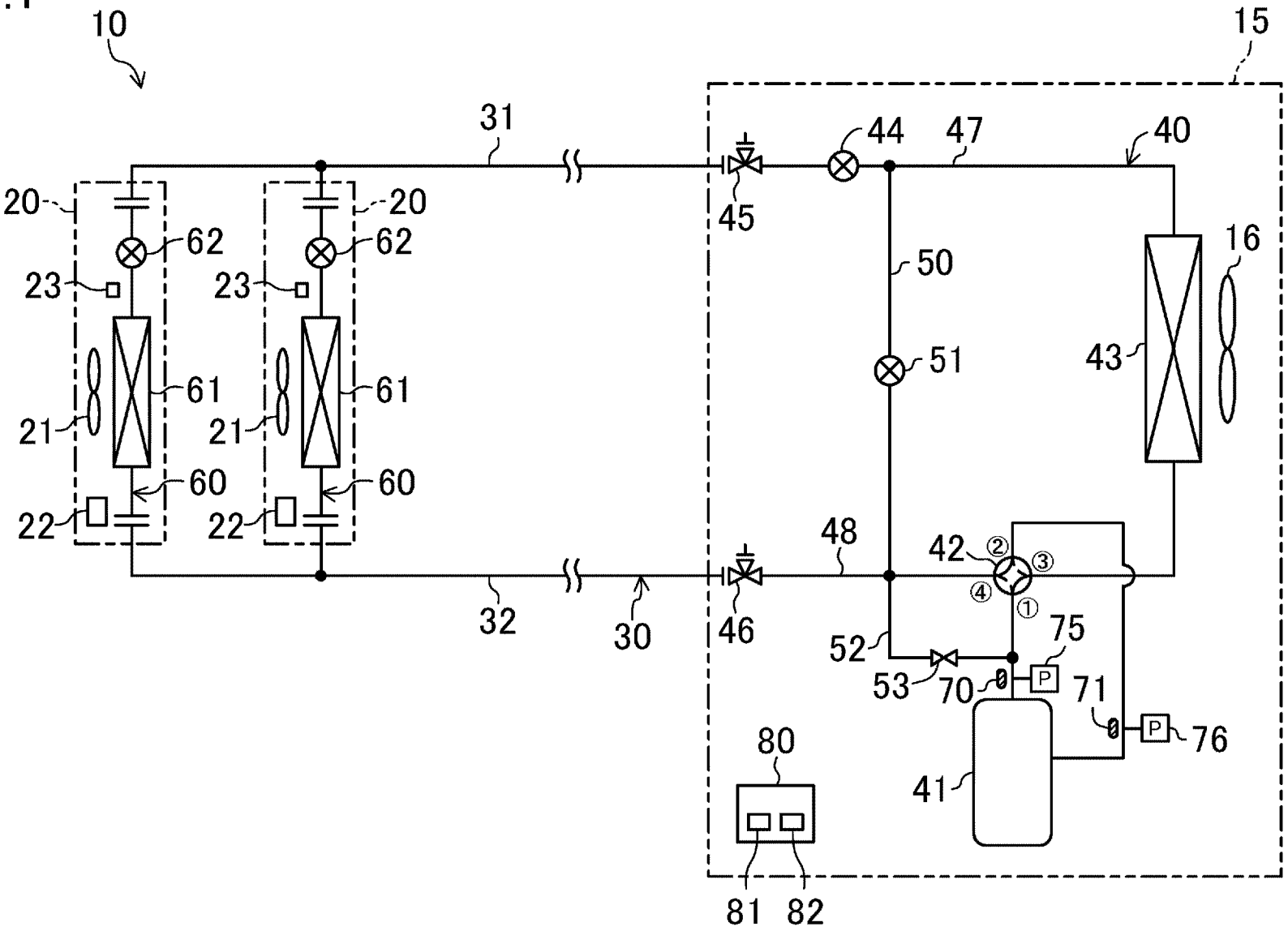
FIG. 1 is a refrigerant circuit diagram illustrating a configuration of an air conditioner according to a first embodiment.

As shown in FIG. 1, the air conditioner (10) of this embodiment includes a single outdoor unit (15) and a plurality of indoor units (20). The numbers of the outdoor unit (15) and the indoor unit (20) shown in FIG. 1 are merely exemplary ones. Specifically, the air conditioner (10) may include a plurality of outdoor units (15), or only one or three or more indoor units (20).

<Outdoor Unit>

The outdoor unit (15) constitutes a heat-source-side unit. The outdoor unit (15) is provided with an outdoor circuit (40), an outdoor fan (16), and an outdoor controller (80). The outdoor fan (16) is a fan for sending outdoor air to an outdoor heat exchanger (43) which will be described later, and constitutes a heat-source-side fan. The outdoor circuit (40) and the outdoor controller (80) will be described later.

<Indoor Unit>

Each indoor unit (20) constitutes an utilization-side unit. Each indoor unit (20) is provided with an indoor circuit (60), an indoor fan (21), an indoor controller (22), and a refrigerant sensor (23).

The indoor fan (21) is a fan for sending indoor air to an indoor heat exchanger (61) which will be described later, and constitutes an utilization-side fan.

Although not shown, the indoor controller (22) includes a memory that stores data necessary for the operation thereof, and a CPU that executes a control operation. The indoor controller (22) is configured to control the indoor fan (21) and an indoor expansion valve (62).

The refrigerant sensor (23) is a sensor configured to output a detection signal when the concentration of a refrigerant in the air exceeds a predetermined reference concentration. The refrigerant sensor (23) constitutes a leakage detection unit that detects the leakage of the refrigerant from the indoor circuit (60). The detection signal of the refrigerant sensor (23) is a leakage signal indicating a leakage of a refrigerant from the indoor circuit (60). The indoor circuit (60) will be described later.

—Configuration of Refrigerant Circuit—

In the air conditioner (10), the outdoor circuit (40) of the outdoor unit (15) and the indoor circuit (60) of the indoor unit (20) are connected together by a liquid side connection pipe (31) and a gas side connection pipe (32) to constitute a refrigerant circuit (30). The refrigerant circuit (30) is filled with, for example, HFC-32 used as the refrigerant. The liquid side connection pipe (31) is a pipe for connecting a liquid side end of each indoor circuit (60) to a liquid-side shutoff valve (45) of the outdoor circuit (40). The gas side connection pipe (32) is a pipe for connecting a gas side end of each indoor circuit (60) to a gas-side shutoff valve (46) of the outdoor circuit (40). In the refrigerant circuit (30), the indoor circuits (60) of the indoor units (20) are connected in parallel to each other.

<Outdoor Circuit>

The outdoor circuit (40) constitutes a heat-source-side circuit. The outdoor circuit (40) is provided with a compressor (41), a four-way switching valve (42), an outdoor heat exchanger (43), an outdoor expansion valve (44), the liquid-side shutoff valve (45), and the gas-side shutoff valve (46). The outdoor circuit (40) is provided with a liquid side bypass pipe (50) and a gas side bypass pipe (52).

In the outdoor circuit (40), the compressor (41) has a discharge pipe connected to a first port of the four-way switching valve (42), and a suction pipe connected to a second port of the four-way switching valve (42). The four-way switching valve (42) has a third port connected to a gas side end of the outdoor heat exchanger (43), and a fourth port connected to the gas-side shutoff valve (46). A liquid side end of the outdoor heat exchanger (43) is connected to the liquid-side shutoff valve (45) via the outdoor expansion valve (44). In the outdoor circuit (40), a pipe connecting the outdoor heat exchanger (43) and the liquid-side shutoff valve (45) constitutes a liquid side pipe (47), and a pipe connecting the fourth port of the four-way switching valve (42) and the gas-side shutoff valve (46) constitutes a gas side pipe (48).

The compressor (41) is a hermetic scroll compressor. Although not shown in the drawings, in the compressor (41), a compression mechanism made of a scroll-type fluid machine and an electric motor for driving the compression mechanism are housed in a casing in the form of a closed container. A refrigerant discharged from or to be sucked into the compression mechanism flows in an internal space of the casing.

The compressor (41) has a variable operating capacity. Specifically, an alternating current is supplied to the electric motor of the compressor (41) via an inverter (not shown). When the inverter changes the frequency of the alternating current supplied to the compressor (i.e., an operation frequency of the compressor (41)), rotational speed of the compressor (41) changes, and as a result, the operating capacity of the compressor (41) changes.

The four-way switching valve (42) is a valve that switches between a first state in which the first port communicates with the third port and the second port communicates with the fourth port (indicated by solid curves FIG. 1), and a second state in which the first port communicates with the fourth port and the second port communicates with the third port (indicated by broken curves in FIG. 1).

The outdoor heat exchanger (43) is what is called a cross-fin, fin-and-tube heat exchanger, and exchanges heat between the refrigerant and the air. The outdoor heat exchanger (43) constitutes a heat-source-side heat exchanger. The outdoor expansion valve (44) is an electronic expansion valve having a variable opening degree and a valve body driven by a stepping motor. The outdoor expansion valve (44) also serves as a liquid side control valve for closing the liquid side pipe (47) in a refrigerant recovery operation which will be described later.

The liquid side bypass pipe (50) has one end connected to a portion of the liquid side pipe (47) connecting the outdoor heat exchanger (43) and the outdoor expansion valve (44), and the other end connected to the gas side pipe (48). The liquid side bypass pipe (50) is a pipe that allows the portion of the liquid side pipe (47) between the outdoor heat exchanger (43) and the outdoor expansion valve (44) to communicate with the suction side of the compressor (41). The liquid side bypass pipe (50) is provided with a liquid side bypass valve (51). The liquid side bypass valve (51) is an electric valve whose valve body is driven by a stepping motor. That is, the liquid side bypass valve (51) is a control valve whose opening degree in an open state is variable.

The gas side bypass pipe (52) has one end connected to a pipe connecting the discharge pipe of the compressor (41) and the first port of the four-way switching valve (42), and the other end connected to the gas side pipe (48). The gas side bypass pipe (52) is a pipe that allows the discharge side of the compressor (41) to communicate with the suction side of the compressor (41). The other end of the gas side bypass pipe (52) is connected to the gas side pipe (48) at the substantially same position as the liquid side bypass pipe (50). The gas side bypass pipe (52) is provided with a gas side bypass valve (53). The gas side bypass valve (53) is an electromagnetic valve whose valve body is driven by a solenoid. That is, the gas side bypass valve (53) is an open-close valve whose opening degree in an open state is fixed.

In the outdoor circuit (40), a discharge temperature sensor (70) and a discharge pressure sensor (75) are provided for the pipe connecting the discharge pipe of the compressor (41) and the first port of the four-way switching valve (42). The discharge temperature sensor (70) measures the temperature of the refrigerant discharged from the compressor (41). The discharge pressure sensor (75) measures the pressure of the refrigerant discharged from the compressor (41). In the outdoor circuit (40), a suction temperature sensor (71) and a suction pressure sensor (76) are provided for a pipe connecting the suction pipe of the compressor (41) and the second port of the four-way switching valve (42). The suction temperature sensor (71) measures the temperature of the refrigerant to be sucked into the compressor (41). The suction pressure sensor (76) measures the pressure of the refrigerant to be sucked into the compressor (41).

<Indoor Circuit>

The indoor circuit (60) constitutes an utilization-side circuit. The indoor circuit (60) is provided with an indoor heat exchanger (61) and an indoor expansion valve (62). In the indoor circuit (60), the indoor heat exchanger (61) and the indoor expansion valve (62) are arranged in series from the gas side end to the liquid side end of the indoor circuit (60).

The indoor heat exchanger (61) is what is called a cross-fin, fin-and-tube heat exchanger, and exchanges heat between the refrigerant and the air. The indoor heat exchanger (61) constitutes an utilization-side heat exchanger. The indoor expansion valve (62) is an electronic expansion valve having a variable opening degree and a valve body driven by a stepping motor.

—Configuration of Outdoor Controller—

As shown in FIG. 1, the outdoor controller (80) includes a CPU (81) that executes a control operation including a refrigerant recovery control operation which will be described later, and a memory (82) that stores data necessary for the control operation executed by the CPU (81). The outdoor controller (80) receives measurement values of the discharge temperature sensor (70), the suction temperature sensor (71), the discharge pressure sensor (75), and the suction pressure sensor (76). The outdoor controller (80) also receives the detection signal of the refrigerant sensor (23) provided for each indoor unit (20).

Figure 2:
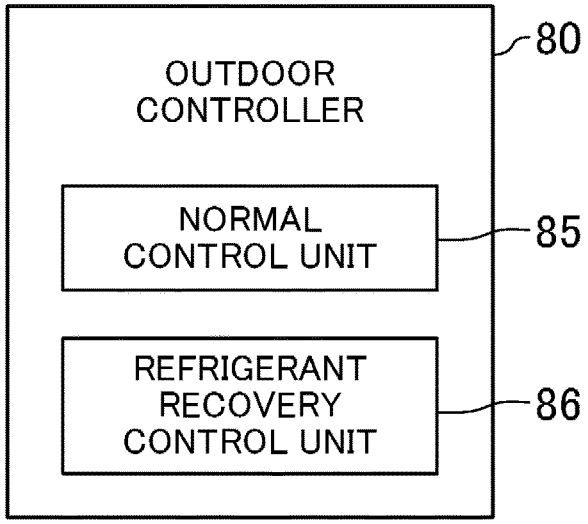
FIG. 2 is a block diagram illustrating a configuration of an outdoor controller according to the first embodiment.

As shown in FIG. 2, the outdoor controller (80) includes a normal control unit (85) and a refrigerant recovery control unit (86). The normal control unit (85) is configured to execute a normal control operation for controlling the components of the air conditioner (10) in a cooling operation and a heating operation, both of which will be described later. The refrigerant recovery control unit (86) is configured to execute a refrigerant recovery control operation for controlling the components of the air conditioner (10) in a refrigerant recovery control operation which will be described later.

—Operation of Air Conditioner—

The air conditioner (10) of this embodiment selectively executes a cooling operation and a heating operation. In addition, the air conditioner (10) executes the refrigerant recovery operation when the refrigerant has leaked from the indoor circuit (60) during the cooling operation or the heating operation.

<Cooling Operation>

The cooling operation of the air conditioner (10) will be described below. In the cooling operation, the normal control unit (85) of the outdoor controller (80) sets the four-way switching valve (42) to the first state, keeps the outdoor expansion valve (44) fully open, keeps the liquid side bypass valve (51) and the gas side bypass valve (53) closed, and actuates the outdoor fan (16). In the cooling operation, the indoor controller (22) of each indoor unit (20) adjusts the opening degree of the indoor expansion valve (62), and actuates the indoor fan (21).

When the normal control unit (85) of the outdoor controller (80) actuates the compressor (41), the refrigerant circulates in the refrigerant circuit (30) to perform a refrigeration cycle. In this cycle, in the refrigerant circuit (30), the outdoor heat exchanger (43) functions as a condenser (i.e., a radiator), and each indoor heat exchanger (61) functions as an evaporator.

Specifically, the refrigerant discharged from the compressor (41) flows into the outdoor heat exchanger (43) after passing through the four-way switching valve (42), and dissipates heat to the outdoor air to condense. The refrigerant condensed in the outdoor heat exchanger (43) flows into the liquid side connection pipe (31) through the liquid side pipe (47), and then is distributed to the indoor circuits (60). The refrigerant that has flowed into each indoor circuit (60) is decompressed when it passes through the indoor expansion valve (62), flows into the indoor heat exchanger (61), and absorbs heat from the indoor air to evaporate. Each indoor unit (20) blows the air cooled in the indoor heat exchanger (61) into the room. The flows of the refrigerant evaporated in the indoor heat exchangers (61) of the indoor circuits (60) enter the gas side connection pipe (32) to merge together, and then the merged refrigerant sequentially passes through the gas side pipe (48) of the outdoor circuit (40) and the four-way switching valve (42) to be sucked into the compressor (41). The refrigerant sucked into the compressor (41) is compressed and discharged from the compressor (41).

In the cooling operation, the normal control unit (85) of the outdoor controller (80) executes a control operation of adjusting the operating capacity of the compressor (41). Specifically, the normal control unit (85) adjusts an output frequency of the inverter that supplies the alternating current to the compressor (41) so that the measurement value of the suction pressure sensor (76) (i.e., the low pressure of the refrigeration cycle) reaches a predetermined target value.

<Heating Operation>

The heating operation of the air conditioner (10) will be described below. In the heating operation, the normal control unit (85) of the outdoor controller (80) sets the four-way switching valve (42) to the second state, adjusts the opening degree of the outdoor expansion valve (44), keeps the liquid side bypass valve (51) and the gas side bypass valve (53) closed, and actuates the outdoor fan (16). In the heating operation, the indoor controller (22) of each indoor unit (20) adjusts the opening degree of the indoor expansion valve (62), and actuates the indoor fan (21).

When the normal control unit (85) of the outdoor controller (80) actuates the compressor (41), the refrigerant circulates in the refrigerant circuit (30) to perform a refrigeration cycle. In this cycle, in the refrigerant circuit (30), each indoor heat exchanger (61) functions as a condenser, and the outdoor heat exchanger (43) functions as an evaporator.

Specifically, the refrigerant discharged from the compressor (41) sequentially passes through the four-way switching valve (42) and the gas side pipe (48), flows into the gas side connection pipe (32), and is distributed to the indoor circuits (60). The refrigerant that has flowed into each indoor circuit (60) flows into the indoor heat exchanger (61), and dissipates heat to the indoor air to condense. Each indoor unit (20) blows the air heated in the indoor heat exchanger (61) into the room. The flows of the refrigerant condensed in the indoor heat exchangers (61) of the indoor circuits (60) enter the liquid side connection pipe (31) after passing through the indoor expansion valves (62) and merge together, and then the merged refrigerant flows into the liquid side pipe (47) of the outdoor circuit (40). The refrigerant that has flowed into the liquid side pipe (47) is decompressed when it passes through the outdoor expansion valve (44), flows into the outdoor heat exchanger (43), and absorbs heat from the outdoor air to evaporate. The refrigerant evaporated in the outdoor heat exchanger (43) is sucked into the compressor (41) after passing through the four-way switching valve (42). The refrigerant sucked into the compressor (41) is compressed and discharged from the compressor (41).

In the heating operation, the normal control unit (85) of the outdoor controller (80) executes a control operation of adjusting the operating capacity of the compressor (41). Specifically, the normal control unit (85) adjusts an output frequency of the inverter that supplies the alternating current to the compressor (41) so that the measurement value of the discharge pressure sensor (75) (i.e., the high pressure of the refrigeration cycle) reaches a predetermined target value.

<Refrigerant Recovery Operation>

The refrigerant recovery operation of the air conditioner (10) will be described below. This refrigerant recovery operation is an operation performed to recover the refrigerant in the indoor circuit (60) to the outdoor circuit (40) if the refrigerant leaks from at least one of the indoor circuits (60).

As described above, the refrigerant sensor (23) provided for each indoor unit (20) outputs the detection signal when the concentration of the refrigerant in the air exceeds a predetermined reference concentration. Receiving the detection signal from at least one refrigerant sensor (23), the refrigerant recovery control unit (86) of the outdoor controller (80) executes the refrigerant recovery control operation to cause the air conditioner (10) to executes the refrigerant recovery operation.

In the refrigerant recovery control operation, the refrigerant recovery control unit (86) of the outdoor controller (80) keeps the outdoor expansion valve (44) fully closed, and actuates the outdoor fan (16). If the compressor (41) is in operation at the start of the refrigerant recovery control operation, the refrigerant recovery control unit (86) keeps the compressor (41) operating. If the compressor (41) is not in operation at the start of the refrigerant recovery control operation, the refrigerant recovery control unit (86) starts the compressor (41).

The refrigerant recovery control unit (86) starts the valve control operation simultaneously with the start of the refrigerant recovery control operation. In the valve control operation, the refrigerant recovery control unit (86) opens the liquid side bypass valve (51) and the gas side bypass valve (53). In the valve control operation, the refrigerant recovery control unit (86) adjusts the opening degree of the liquid side bypass valve (51). The operation executed by the refrigerant recovery control unit (86) to adjust the opening degree of the liquid side bypass valve (51) will be described later.

In the refrigerant recovery control operation, the refrigerant recovery control unit (86) sets the four-way switching valve (42) to the first state. That is, the refrigerant recovery control unit (86) keeps the four-way switching valve (42) in the first state when receiving the detection signal from the refrigerant sensor (23) during the cooling operation, and switches the four-way switching valve (42) from the second state to the first state when receiving the detection signal from the refrigerant sensor (23) during the heating operation. Further, the refrigerant recovery control unit (86) outputs a command signal to the indoor controller (22) of each indoor unit (20) to instruct the indoor controller (22) to operate the indoor fan (21) so as to keep the indoor expansion valve (62) fully opened.

In this state, in the refrigerant circuit (30), the refrigerant present in the liquid side connection pipe (31) and each indoor circuit (60) is sucked into the compressor (41) to be recovered in the outdoor circuit (40). Specifically, the refrigerant in the liquid side connection pipe (31) and the indoor circuit (60) flows into the gas side pipe (48) of the outdoor circuit (40) through the gas side connection pipe (32), and then is sucked into the compressor (41) through the four-way switching valve (42). The refrigerant sucked into the compressor (41) is compressed, discharged from the compressor (41) to flow into the outdoor heat exchanger (43), and dissipates heat to the outdoor air to condense. Since the outdoor expansion valve (44) is fully closed, the refrigerant condensed in the outdoor heat exchanger (43) is stored in the outdoor circuit (40).

In the refrigerant recovery operation, the liquid side bypass valve (51) and the gas side bypass valve (53) are open. Therefore, the compressor (41) sucks the refrigerant present in the liquid side connection pipe (31) and each indoor circuit (60), together with the refrigerant that has flowed from the liquid side bypass pipe (50) into the gas side pipe (48) and the refrigerant that has flowed into the gas side pipe (48) from the gas side bypass pipe (52). The liquid side bypass pipe (50) introduces part of the refrigerant condensed in the outdoor heat exchanger (43) into the gas side pipe (48). The gas side bypass pipe (52) introduces part of the refrigerant discharged from the compressor (41) into the gas side pipe (48).

The refrigerant recovery control unit (86) of the outdoor controller (80) adjusts the opening degree of the liquid side bypass valve (51) such that the refrigerant to be sucked into the compressor (41) is in a gas single-phase state in the valve control operation. In order to keep the refrigerant to be sucked into the compressor (41) in the gas single-phase state, the refrigerant recovery control unit (86) of this embodiment adjusts the opening degree of the liquid side bypass valve (51) to maintain the degree of suction superheat of the compressor (41) (i.e., the degree of superheat of the refrigerant to be sucked into the compressor (41)) within a predetermined range of a target degree of superheat. That is, the refrigerant recovery control unit (86) adjusts the opening degree of the liquid side bypass valve (51) so that the degree of suction superheat of the compressor (41) is equal to or larger than the lower limit value, and equal to or smaller than the upper limit value, of the range of the target degree of superheat.

Specifically, the refrigerant recovery control unit (86) calculates the degree of suction superheat of the compressor (41) by using the measurement values of the suction temperature sensor (71) and the suction pressure sensor (76). Then, the refrigerant recovery control unit (86) adjusts the opening degree of the liquid side bypass valve (51) so that the calculated degree of suction superheat of the compressor (41) falls within the predetermined range of the target degree of superheat (e.g., 5° C.±1° C.). That is, the refrigerant recovery control unit (86) increases the opening degree of the liquid side bypass valve (51) when the calculated degree of suction superheat of the compressor (41) exceeds the upper limit value (e.g., 5° C.+1° C.) of the range of the target degree of superheat, and reduces the opening degree of the liquid side bypass valve (51) when the calculated degree of suction superheat of the compressor (41) falls below the lower limit value (e.g., 5° C.−1° C.) of the range of the target degree of superheat. The numerical values of the range of the target degree of superheat shown here are merely exemplary ones. The range of the target degree of superheat may be, for example, from 5° C. to 10° C.

Further, the refrigerant recovery control unit (86) of the outdoor controller (80) adjusts the operating capacity of the compressor (41) to maintain the measurement value of the suction pressure sensor (76) within a target pressure range (PT±ΔP) including a predetermined target pressure PT. Specifically, the refrigerant recovery control unit (86) increases the rotational speed of the compressor (41) to increase the operating capacity of the compressor (41) when the measurement value of the suction pressure sensor (76) exceeds the upper limit value (PT+ΔP) of the target pressure range, and reduces the rotational speed of the compressor (41) to reduce the operating capacity of the compressor (41) when the measurement value of the suction pressure sensor (76) falls below the lower limit value (PT−ΔP) of the target pressure range.

The target pressure PT is set to be a value which is higher than the atmospheric pressure and at which the speed of the refrigerant leaking from the indoor circuit (60) (i.e., the mass of the refrigerant leaking from the indoor circuit (60) per unit time) is equal to or less than a predetermined upper limit speed. Here, the leakage of the refrigerant from the refrigerant circuit (30) is often caused by a hole formed in the pipe or the heat transfer tube due to corrosion. The diameter of the hole formed by corrosion is said to be at most about 0.2 mm. Therefore, when the diameter of the hole in the pipe or the like is 0.2 mm, the target pressure PT is desirably set to be a value at which the speed of the refrigerant leaking from the hole is equal to or less than the upper limit speed.

When the measurement value of the suction pressure sensor (76) is maintained approximately at the target pressure for a certain period of time or more, only the gas refrigerant remains in the liquid side connection pipe (31) and each of the indoor circuits (60). In this state, the compressor (41) substantially sucks only the refrigerant that has flowed from the liquid side bypass pipe (50) into the gas side pipe (48) and the refrigerant that has flowed from the gas side bypass pipe (52) into the gas side pipe (48).

Figure 3:
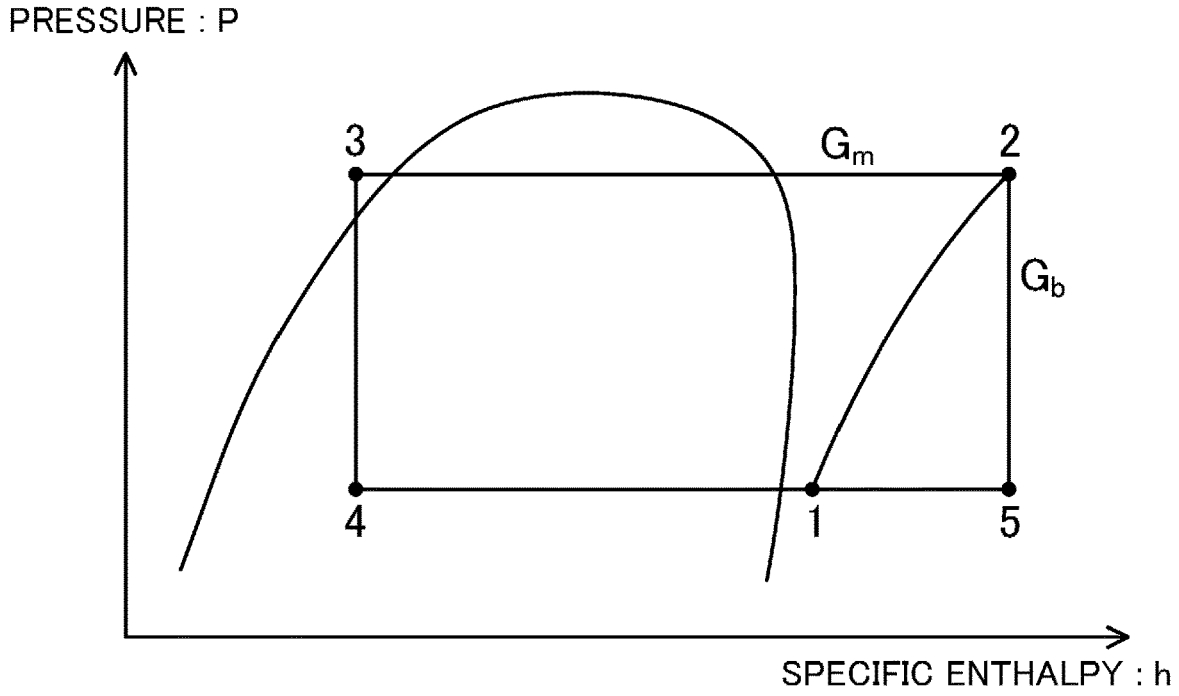
FIG. 3 is a Mollier diagram (pressure-enthalpy diagram) illustrating the state of a refrigerant in a refrigerant circuit during a refrigerant recovery operation executed by the air conditioner.

The state of the refrigerant in the refrigerant circuit (30) in this situation will be described with reference to a Mollier diagram (pressure-enthalpy diagram) shown in FIG. 3. In the refrigerant circuit (30), the refrigerant in the state of point 2 in FIG. 3 is discharged from the compressor (41). Part of the refrigerant in the state of point 2 (mass flow rate: Gb) flows into the gas side bypass pipe (52), and the remainder (mass flow rate: Gm) flows into the outdoor heat exchanger (43).

The refrigerant in the state of point 2 that has flowed into the outdoor heat exchanger (43) dissipates heat to the outdoor air to be the state of point 3 (supercooled state), flows into the liquid side bypass pipe (50), expands when passing through the liquid side bypass valve (51) to be the state of point 4 (gas-liquid two-phase state), and thereafter, flows into the gas side pipe (48). On the other hand, the refrigerant in the state of point 2 that has flowed into the gas side bypass pipe (52) expands when passing through the gas side bypass valve (53) to be the state of point 5 (superheated state), and then flows into the gas side pipe (48).

In the gas side pipe (48), the refrigerant in the state of point 4 that has flowed from the liquid side bypass pipe (50) and the refrigerant in the state of point 5 that has flowed from the gas side bypass pipe (52) merge together to be the state of point 1 (superheated state). Then, the refrigerant in the state of point 1 is sucked into the compressor (41).

The refrigerant in the state of point 1 shown in FIG. 3 has a pressure that is approximately the target pressure, and a degree of superheat that is approximately the target degree of suction superheat. That is, even when the recovery of the refrigerant from the liquid side connection pipe (31) and the indoor circuit (60) to the outdoor circuit (40) is substantially completed, the degree of suction superheat of the compressor (41) is maintained at a relatively small value. Therefore, even in this state, the compressor (41) can continue to operate while avoiding an excessive rise in the discharge temperature of the compressor (41) (specifically, the measurement value of the discharge temperature sensor (70)). In the refrigerant recovery operation, the refrigerant in the gas side pipe (48) communicating with the indoor circuit (60) via the gas side connection pipe (32) is in the state of point 1 in FIG. 3. Therefore, while the compressor (41) keeps operating in this state, the state of the refrigerant remaining in the liquid side connection pipe (31) and the indoor circuit (60) is maintained in the state of point 1 in FIG. 3 (i.e., the gas single-phase state).

—Advantages of First Embodiment—

In the air conditioner (10) of this embodiment, when the refrigerant sensor (23) of at least one indoor unit (20) outputs the detection signal, the outdoor controller (80) executes the refrigerant recovery control operation, and the compressor (41) sucks the refrigerant that has flowed from the indoor circuit (60) into the outdoor circuit (40), together with the refrigerant flowing in the liquid side bypass pipe (50) and the refrigerant flowing in the gas side bypass pipe (52). Therefore, the degree of suction superheat of the compressor (41) can be reduced to a certain level or less so that the compressor (41) can continue to operate while avoiding an excessive rise in the discharge temperature of the compressor (41), and the refrigerant in the indoor circuit (60) can be kept sucked into the compressor (41). Therefore, according to this embodiment, when the refrigerant sensor (23) detects the leakage of the refrigerant from the indoor circuit (60), the amount of refrigerant remaining in the indoor circuit (60) can be sufficiently reduced, and the amount of refrigerant leaking from the indoor circuit (60) can be reliably reduced.

If the indoor circuit (60) is damaged and the air enters the refrigerant circuit (30) from the damaged part of the indoor circuit (60), the damaged part of the indoor circuit (60) needs to be repaired, and in addition, the air needs to be eliminated from the refrigerant circuit (30). This results in an increase in man-hour and cost required for the repair of the air conditioner (10).

In contrast, according to the air conditioner (10) of this embodiment, when the refrigerant sensor (23) detects that the refrigerant has leaked from the indoor circuit (60), the outdoor controller (80) adjusts the operating capacity of the compressor (41) to keep the pressure in the indoor circuit (60) higher than the atmospheric pressure. Thus, even if the indoor circuit (60) is damaged, the air can be blocked from entering the refrigerant circuit (30) from the damaged part of the indoor circuit (60). Therefore, according to this embodiment, the man-hour and cost required for the repair of the air conditioner (10) when the indoor circuit (60) is damaged can be reduced.

According to the air conditioner (10) of this embodiment, the refrigerant recovery control unit (86) of the outdoor controller (80) adjusts the opening degree of the liquid side bypass valve (51) in the refrigerant recovery operation. This can maintain the degree of suction superheat of the compressor (41) at approximately the target degree of suction superheat. In the refrigerant recovery operation of the air conditioner (10), when the indoor circuit (60) has continued to communicate with the suction side of the compressor (41) for a certain period of time or more, the refrigerant in the indoor circuit (60) enters substantially the same state as the refrigerant to be sucked into the compressor (41). Therefore, according to this embodiment, the refrigerant in the indoor circuit (60) can be maintained in the gas single-phase state, and as a result, the amount of refrigerant leaking from the indoor circuit (60) can be reduced as much as possible.

In the air conditioner (10) of this embodiment, both of the liquid side bypass pipe (50) and the gas side bypass pipe (52) are connected to the gas side pipe (48) connecting the four-way switching valve (42) and the gas-side shutoff valve (46). Therefore, after a certain period of time has passed since the compressor (41) was started by the refrigerant recovery control operation of the outdoor controller (80), the refrigerant in the indoor circuit (60) can be kept in almost the same state as the refrigerant to be sucked into the compressor (41). This can allow only a small amount of refrigerant to remain in the indoor circuit (60).

Second Embodiment

A second embodiment will be described below. An air conditioner (10) of this embodiment is a modified version, of the air conditioner (10) of the first embodiment, in which the configuration of the outdoor circuit (40) has been changed. Thus, the following description will be focused on the differences between the air conditioner (10) of this embodiment and the air conditioner (10) of the first embodiment.

Figure 4:
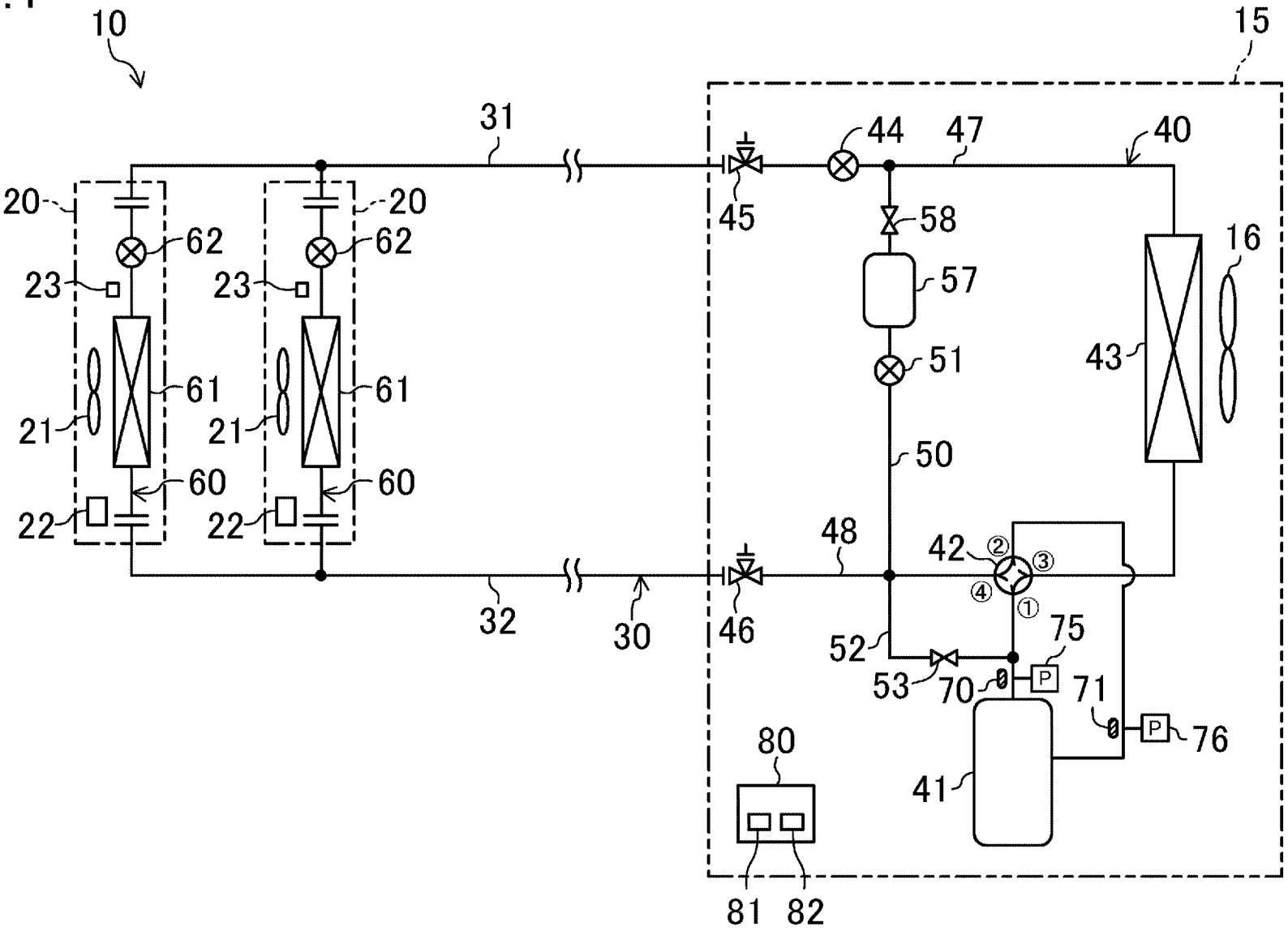
FIG. 4 is a refrigerant circuit diagram illustrating a configuration of an air conditioner according to a second embodiment.

As shown in FIG. 4, in the air conditioner (10) of this embodiment, a receiver (57) and a bypass open-close valve (58) are provided for the liquid side bypass pipe (50) of the outdoor circuit (40). In the liquid side bypass pipe (50) of this embodiment, the receiver (57) is arranged closer to the liquid side pipe (47) than the liquid side bypass valve (51) is, and the bypass open-close valve (58) is arranged closer to the liquid side pipe (47) than the receiver (57) is. The receiver (57) constitutes a container member for storing the refrigerant. The bypass open-close valve (58) is an electromagnetic valve that can be opened and closed.

In this embodiment, the normal control unit (85) of the outdoor controller (80) keeps the bypass open-close valve (58) closed in the cooling and heating operations of the air conditioner (10). On the other hand, the refrigerant recovery control unit (86) of the outdoor controller (80) keeps the bypass open-close valve (58) open in the refrigerant recovery operation of the air conditioner (10). In the refrigerant recovery operation of the air conditioner (10), the refrigerant recovered from the liquid side connection pipe (31) and the indoor circuit (60) to the outdoor circuit (40) is condensed in the outdoor heat exchanger (43), and then flows into the receiver (57) to be stored therein.

In response to satisfaction of a condition for terminating the refrigerant recovery operation of the air conditioner (10) (i.e., a condition for terminating the refrigerant recovery control operation), the refrigerant recovery control unit (86) closes the liquid side bypass valve (51) and the bypass open-close valve (58) to stop the compressor (41). The refrigerant that has flowed into the receiver (57) in the refrigerant recovery operation keeps remaining in the receiver (57) after the compressor (41) is stopped. Therefore, according to this embodiment, the amount of the refrigerant remaining in the indoor circuit (60) can be kept small even after the refrigerant recovery operation of the air conditioner (10) is completed and the compressor (41) is stopped.

The condition for terminating the refrigerant recovery operation is, for example, a condition that "a duration in which the measurement value of the suction pressure sensor (76) is maintained within a target range including a target pressure exceeds a predetermined reference time."

Third Embodiment

A third embodiment will be described below. An air conditioner (10) of this embodiment is a modified version, of the air conditioner (10) of the second embodiment, in which the outdoor circuit (40) has been changed. Thus, the following description will be focused on the differences between the air conditioner (10) of this embodiment and the air conditioner (10) of the second embodiment.

Figure 5:
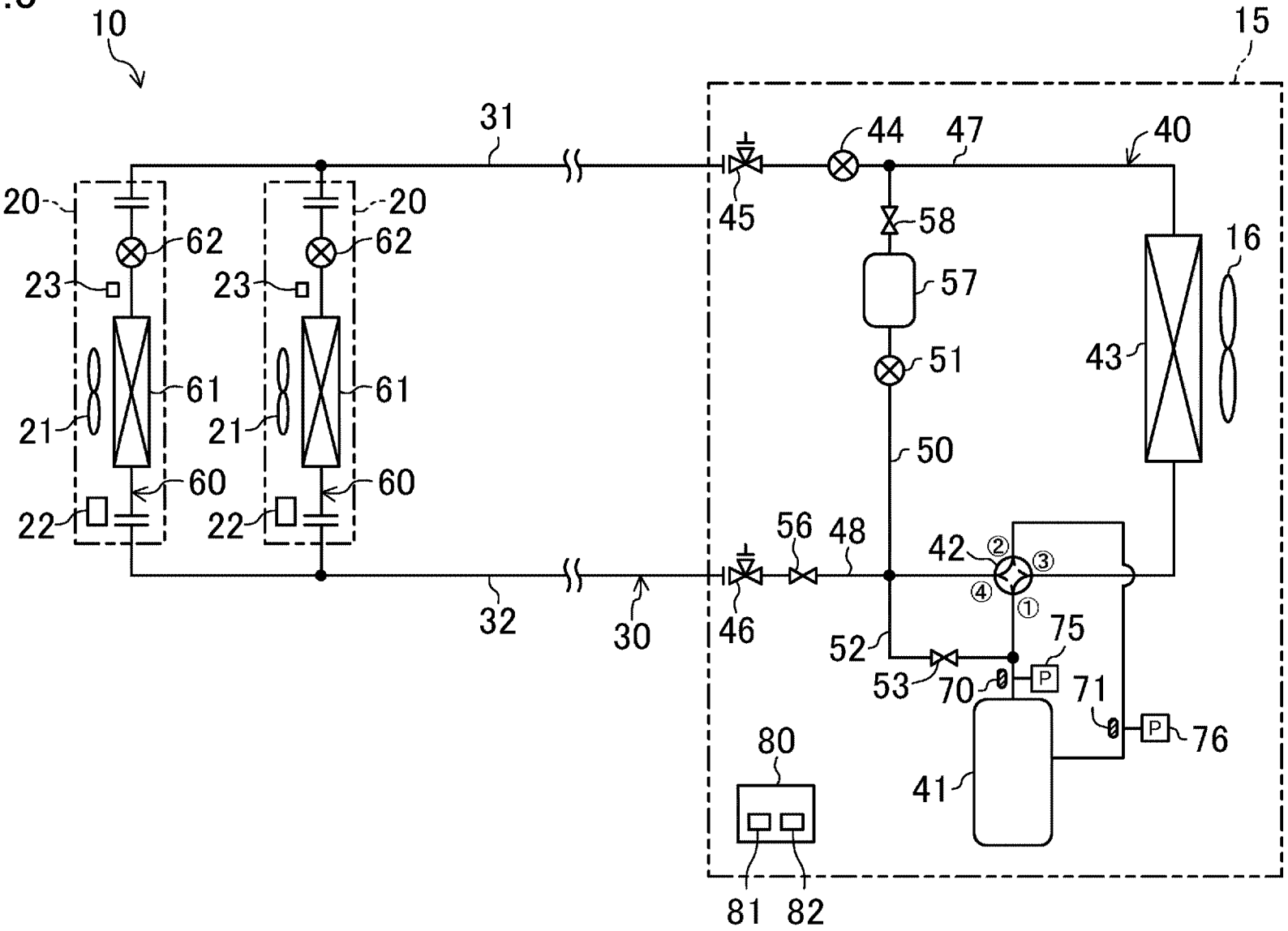
FIG. 5 is a refrigerant circuit diagram illustrating a configuration of an air conditioner according to a third embodiment.

As shown in FIG. 5, in the air conditioner (10) of this embodiment, a gas side open-close valve (56) is provided for the gas side pipe (48) of the outdoor circuit (40). In the gas side pipe (48), the gas side open-close valve (56) is arranged closer to the gas-side shutoff valve (46) than a junction of the gas side pipe (48) with the liquid side bypass pipe (50) and the gas side bypass pipe (52) is. The gas side open-close valve (56) is an electromagnetic valve that can be opened and closed, and constitutes a gas side control valve.

In this embodiment, the normal control unit (85) of the outdoor controller (80) keeps the gas side open-close valve (56) open in the cooling and heating operations of the air conditioner (10). The refrigerant recovery control unit (86) of the outdoor controller (80) keeps the gas side open-close valve (56) open in the refrigerant recovery operation of the air conditioner (10). In response to satisfaction of a condition for terminating the refrigerant recovery operation of the air conditioner (10), the refrigerant recovery control unit (86) closes the gas side open-close valve (56) and stops the compressor (41). The condition for terminating the refrigerant recovery operation can be the same as that described in the second embodiment.

In the air conditioner (10) of this embodiment, in response to satisfaction of the condition for terminating the refrigerant recovery operation, both of the outdoor expansion valve (44) and the gas side open-close valve (56) are closed, and the outdoor circuit (40) and the indoor circuit (60) in the refrigerant circuit (30) are completely blocked from each other. Therefore, even after the compressor (41) is stopped, the refrigerant recovered in the outdoor circuit (40) does not return to the indoor circuit (60). Therefore, according to this embodiment, the amount of the refrigerant remaining in the indoor circuit (60) can be kept small even after the refrigerant recovery operation of the air conditioner (10) is completed and the compressor (41) is stopped.

In the air conditioner (10) of the first embodiment shown in FIG. 1, the gas side open-close valve (56) may be provided for the gas side pipe (48) of the outdoor circuit (40).

Fourth Embodiment

A fourth embodiment will be described below. This embodiment is directed a refrigerating machine (10) constituted of a refrigeration apparatus. The refrigerating machine (10) is installed in, for example, a refrigerated warehouse, to cool the interior space of the refrigerated warehouse. The following description will be focused on the differences between the refrigerator (10) of this embodiment and the air conditioner of the first embodiment shown in FIG. 1.

Figure 6:
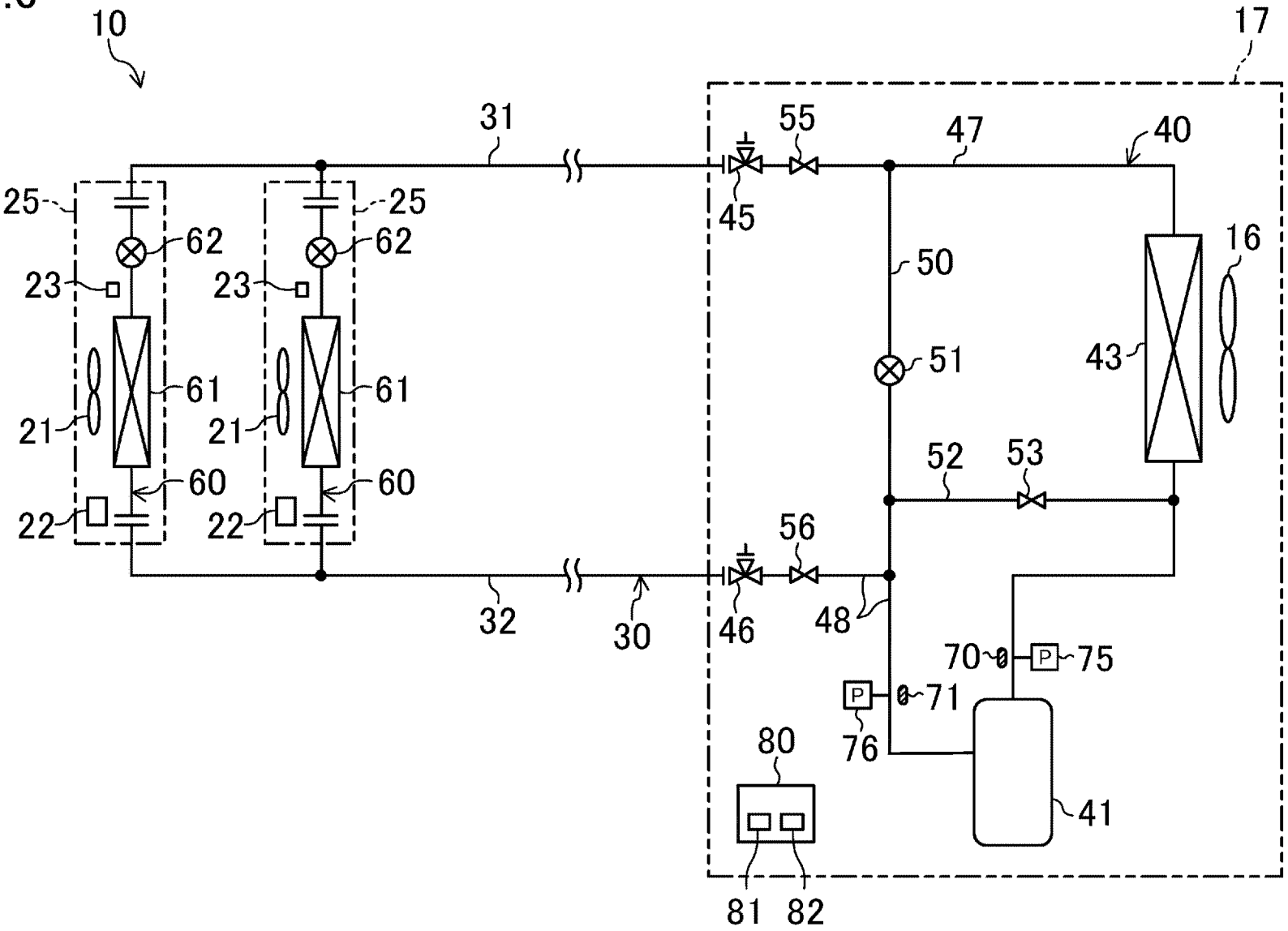
FIG. 6 is a refrigerant circuit diagram illustrating a configuration of a refrigerator according to a fourth embodiment.

As shown in FIG. 6, the refrigerator (10) of this embodiment includes a single condensing unit (17) and a plurality of unit coolers (25). The numbers of the condensing units (17) and the unit coolers (25) shown in FIG. 6 are merely exemplary ones. That is, the refrigerator (10) may be provided with a plurality of condensing units (17), or may be provided with one or three or more unit coolers (25).

<Condensing Unit>

The condensing unit (17) constitutes a heat-source-side unit. Similarly to the outdoor unit (15) of the first embodiment, the condensing unit (17) is provided with an outdoor circuit (40), an outdoor fan (16), and an outdoor controller (80).

The outdoor circuit (40) of the condensing unit (17) has a configuration different from the outdoor unit (15) of the first embodiment. Specifically, the outdoor circuit (40) of this embodiment has no four-way switching valve (42) and outdoor expansion valve (44). Accordingly, in the outdoor circuit (40), the gas side pipe (48) is directly connected to the suction pipe of the compressor (41), and the discharge pipe of the compressor (41) is directly connected to the gas side end of the outdoor heat exchanger (43). In the outdoor circuit (40), the gas side bypass pipe (52) has one end connected to a pipe connecting the discharge pipe of the compressor (41) and the outdoor heat exchanger (43), and the other end connected to a portion of the liquid side bypass pipe (50) closer to the gas side pipe (48) than the liquid side bypass valve (51) is.

The outdoor circuit (40) of this embodiment is provided with a liquid side open-close valve (55) and a gas side open-close valve (56). The liquid side open-close valve (55) is an electromagnetic valve provided for the liquid side pipe (47), and constitutes a liquid side control valve. In the liquid side pipe (47), the liquid side open-close valve (55) is arranged closer to the liquid-side shutoff valve (45) than the junction with the liquid side bypass pipe (50). The gas side open-close valve (56) is an electromagnetic valve provided for the gas side pipe (48), and constitutes a gas side control valve. In the gas side pipe (48), the gas side open-close valve (56) is arranged closer to the gas-side shutoff valve (46) than the junction with the liquid side bypass pipe (50).

<Unit Cooler>

Each unit cooler (25) constitutes an utilization-side unit. The unit cooler (25) is provided in a refrigerated warehouse to cool the air inside the refrigerated warehouse. Similarly to the indoor unit (20) of the first embodiment, the unit cooler (25) is provided with an indoor circuit (60), an indoor fan (21), an indoor controller (22), and a refrigerant sensor (23).

—Operation of Refrigerator—

The refrigerator (10) of this embodiment executes a cooling operation. The refrigerator (10) also executes a refrigerant recovery operation when the refrigerant has leaked from the indoor circuit (60) in the cooling operation.

<Cooling Operation>

The cooling operation executed by the refrigerator (10) of this embodiment is the same as the cooling operation executed by the air conditioner of the first embodiment. That is, in the cooling operation, a refrigeration cycle is performed in the refrigerant circuit (30) in which the outdoor heat exchanger (43) functions as a condenser, and each indoor heat exchanger (61) functions as an evaporator.

In the cooling operation, the normal control unit (85) of the outdoor controller (80) keeps the liquid side open-close valve (55) and the gas side open-close valve (56) open, keeps the liquid side bypass valve (51) and the gas side bypass valve (53) closed, and actuates the outdoor fan (16). In the same manner as in the first embodiment, the normal control unit (85) adjusts the operating capacity of the compressor (41) based on the measurement value of the suction pressure sensor (76). In the cooling operation, the indoor controller (22) of each unit cooler (25) adjusts the opening degree of the indoor expansion valve (62) to operate the indoor fan (21).

<Refrigerant Recovery Operation>

The refrigerant recovery operation of the refrigerator (10) will be described below. This refrigerant recovery operation is an operation performed to recover the refrigerant in the indoor circuit (60) to the outdoor circuit (40) if the refrigerant leaks from at least one of the indoor circuits (60). In this point, the refrigerant recovery operation is the same as that executed by the air conditioner of the first embodiment.

In the refrigerant recovery control operation, the refrigerant recovery control unit (86) of the outdoor controller (80) keeps the liquid side open-close valve (55) closed, opens the gas side open-close valve (56), and actuates the outdoor fan (16). If the compressor (41) is in operation at the start of the refrigerant recovery control operation, the refrigerant recovery control unit (86) keeps the compressor (41) operating. If the compressor (41) is not in operation at the start of the refrigerant recovery control operation, the refrigerant recovery control unit (86) starts the compressor (41).

In the same manner as in the first embodiment, the refrigerant recovery control unit (86) of this embodiment starts the valve control operation simultaneously with the start of the refrigerant recovery control operation. The valve control operation executed by the refrigerant recovery control unit (86) of this embodiment is the same as the valve control operation executed by the refrigerant recovery control unit (86) of the first embodiment. That is, the refrigerant recovery control unit (86) of this embodiment opens the gas side bypass valve (53), and adjusts the opening degree of the liquid side bypass valve (51) such that the degree of suction superheat of the compressor (41) is maintained within a predetermined range of a target degree of superheat.

The refrigerant recovery control unit (86) of this embodiment outputs a command signal similar to that described in the first embodiment to each indoor controller (22). Similarly to the first embodiment, the refrigerant recovery control unit (86) adjusts the operating capacity of the compressor (41) such that the measurement value of the suction pressure sensor (76) is maintained within the target pressure range.

In this embodiment, the refrigerant recovery control unit (86) of the outdoor controller (80) keeps the gas side open-close valve (56) open in the refrigerant recovery operation of the refrigerator (10). In response to satisfaction of a condition for terminating the refrigerant recovery operation of the refrigerator (10) (i.e., a condition for terminating the refrigerant recovery control operation), the refrigerant recovery control unit (86) closes the gas side open-close valve (56) and stops the compressor (41). This operation of the refrigerant recovery control unit (86) is the same as the operation executed by the refrigerant recovery control unit (86) of the third embodiment.

—Advantages of Fourth Embodiment—

In the refrigerator (10) of this embodiment, in response to satisfaction of the condition for terminating the refrigerant recovery operation, both of the liquid side open-close valve (55) and the gas side open-close valve (56) are closed, and the outdoor circuit (40) and the indoor circuit (60) in the refrigerant circuit (30) are completely blocked from each other. Therefore, even after the compressor (41) is stopped, the refrigerant recovered in the outdoor circuit (40) does not return to the indoor circuit (60). Therefore, according to this embodiment, the amount of the refrigerant remaining in the indoor circuit (60) can be kept small even after the refrigerant recovery operation of the refrigerator (10) is completed and the compressor (41) is stopped.

Other Embodiments

The air conditioner (10) and the refrigerator (10) of the above-described embodiments may be modified in the following manner.

—First Variation—

Figure 7:
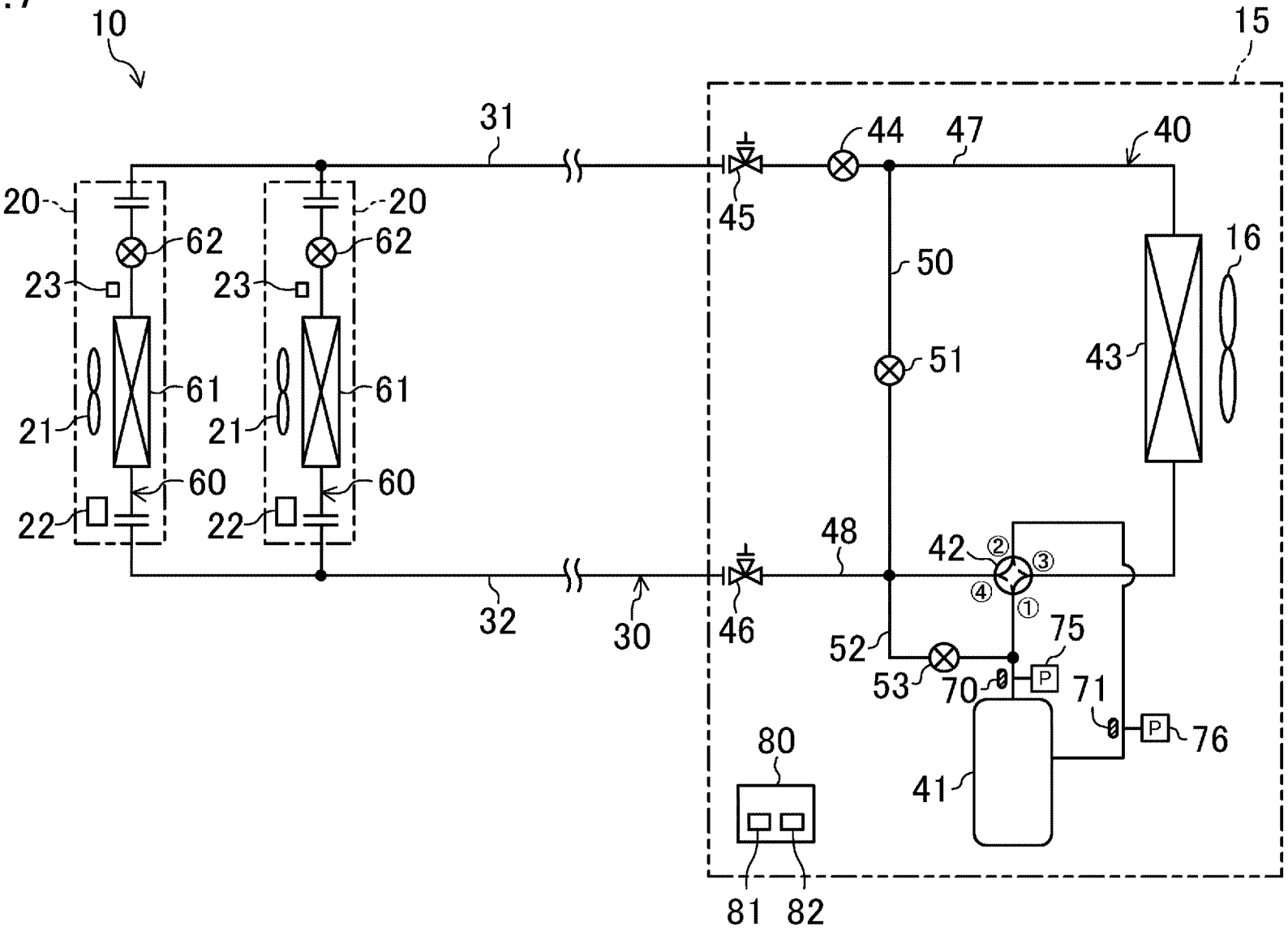
FIG. 7 is a refrigerant circuit diagram illustrating a configuration of an air conditioner according to a first variation of other embodiment.

As shown in FIG. 7, the gas side bypass valve (53) in the air conditioners (10) of the first to third embodiments and the refrigerator (10) of the fourth embodiment may be a control valve whose opening degree in an open state is variable. In the outdoor circuit (40) of this variation, a motor-driven valve whose valve body is driven by a stepping motor is provided as the gas side bypass valve (53) for the gas side bypass pipe (52). FIG. 7 shows an example in which this variation is applied to the air conditioner (10) of the first embodiment.

In the air conditioner (10) or refrigerator (10) of this variation, the refrigerant recovery control unit (86) of the outdoor controller (80) executes, as a valve control operation, an operation of adjusting the opening degree of the liquid side bypass valve (51), and an operation of adjusting the opening degree of the gas side bypass valve (53). An example of the valve control operation executed by the refrigerant recovery control unit (86) of this variation will be described below.

The refrigerant recovery control unit (86) of this variation adjusts the opening degree of the liquid side bypass valve (53) such that the degree of suction superheat of the compressor (41) reaches the target degree of suction superheat with the opening degree of the gas side bypass valve (51) kept constant. If the degree of suction superheat or discharge superheat of the compressor (41) falls below the lower limit value (e.g., 5° C.−1° C.) of the range of the target degree of superheat even when the opening degree of the liquid side bypass valve (51) reaches a predetermined lower limit opening degree, the refrigerant recovery control unit (86) increases the opening degree of the gas side bypass valve (53) only by a predetermined value and maintains the increased opening degree, and continues adjusting the opening degree of the liquid side bypass valve (51) in this state.

—Second Variation—

Figure 8:
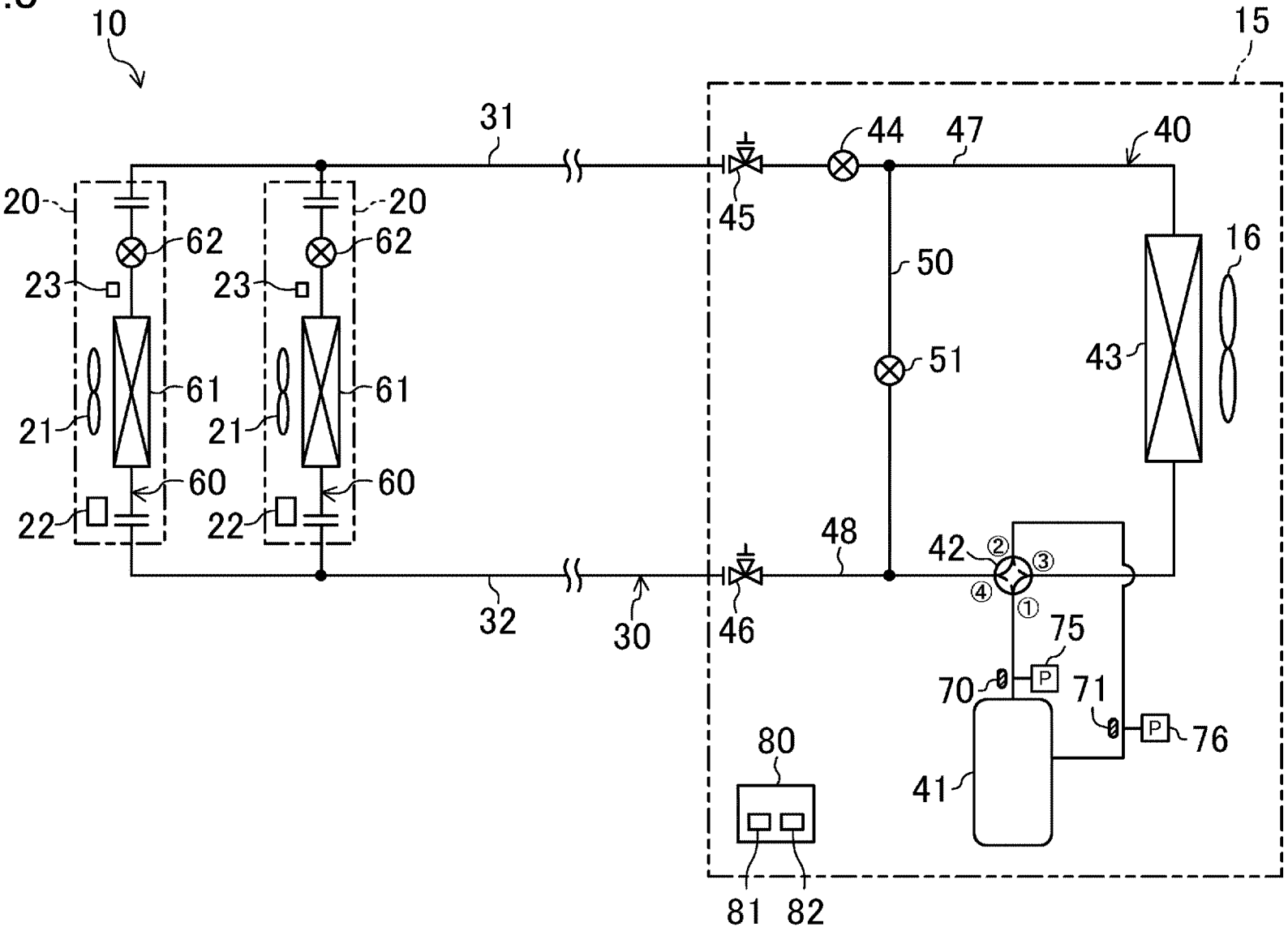
FIG. 8 is a refrigerant circuit diagram illustrating a configuration of an air conditioner according to a second variation of other embodiment.

As shown in FIG. 8, the gas side bypass pipe (52) and the gas side bypass valve (53) may be omitted from the air conditioners (10) of the first to third embodiments and the refrigerator (10) of the fourth embodiment. In the air conditioner (10) or refrigerator (10) of this variation, the refrigerant recovery control unit (86) of the outdoor controller (80) executes an operation of adjusting the opening degree of the liquid side bypass valve (51) as a valve control operation performed in the refrigerant recovery control operation. FIG. 8 shows an example in which this variation is applied to the air conditioner (10) of the first embodiment.

—Third Variation—

The refrigerant recovery control unit (86) of the outdoor controller (80) of each of the first to fourth embodiments may be configured to execute the operation of adjusting the opening degree of the liquid side bypass valve (51) as the valve control operation such that the refrigerant discharged from the compressor (41) has a degree of superheat equal to or more than a predetermined value in the refrigerant recovery control operation.

In the valve control operation, the refrigerant recovery control unit (86) of this variation adjusts the opening degree of the liquid side bypass valve (51) such that the degree of discharge superheat of the compressor (41) (i.e., the degree of superheat of the refrigerant discharged from the compressor (41)) falls within a predetermined range of the target degree of superheat. That is, the refrigerant recovery control unit (86) adjusts the opening degree of the liquid side bypass valve (51) such that the degree of discharge superheat of the compressor (41) is equal to or larger than the lower limit value, and equal to or smaller than the upper limit value, of the range of the target degree of superheat.

Specifically, the refrigerant recovery control unit (86) calculates the degree of discharge superheat of the compressor (41) (i.e., the degree of superheat of the refrigerant discharged from the compressor (41)) by using the measurement values of the discharge temperature sensor (70) and the discharge pressure sensor (75). Then, the refrigerant recovery control unit (86) adjusts the opening degree of the liquid side bypass valve (51) so that the calculated degree of discharge superheat of the compressor (41) falls within the predetermined range of the target degree of superheat (e.g., 5° C.±1° C.). That is, the refrigerant recovery control unit (86) increases the opening degree of the liquid side bypass valve (51) when the calculated degree of discharge superheat of the compressor (41) exceeds the upper limit value (e.g., 5° C.+1° C.) of the range of the target degree of superheat, and reduces the opening degree of the liquid side bypass valve (51) when the calculated degree of discharge superheat of the compressor (41) falls below the lower limit value (e.g., 5° C.−1° C.) of the range of the target degree of superheat. The numerical values of the range of the target degree of superheat shown here are merely exemplary ones. The range of the target degree of superheat may be, for example, from 5° C. to 10° C.

According to this variation, the wetness of the refrigerant to be sucked into the compressor (41) in the refrigerant recovery operation can be reduced to a certain level or less. As a result, the compressor (41) can continue to operate while avoiding damage to the compressor (41) due to suction of the refrigerant having high wetness. This can sufficiently reduce the amount of the refrigerant remaining in the indoor circuit (60), and can reliably reduce the amount of the refrigerant leaking from the indoor circuit (60).

—Fourth Variation—

The refrigerant recovery control unit (86) of the outdoor controller (80) of each of the first to fourth embodiments may start the valve control operation in response to satisfaction of a predetermined condition after the start of the refrigerant recovery control operation, instead of starting the valve control operation simultaneously with the start of the refrigerant recovery control operation.

For example, the refrigerant recovery control unit (86) of this variation may be configured to start the valve control operation in response to satisfaction of a start condition that "a measurement value PL of the suction pressure sensor (76) falls below a predetermined reference pressure PR (PL<PR)" in the refrigerant recovery control operation.

Here, at the start of the refrigerant recovery operation, a relatively large amount of liquid refrigerant may be present in the indoor heat exchanger (61). In this case, even when both of the liquid side bypass valve (51) and the gas side bypass valve (53) are closed for some time after the start of the refrigerant recovery operation, the suction pressure of the compressor (41) is maintained at a certain level or higher, and the discharge temperature of the compressor (41) is also kept at a certain level or lower. Therefore, the refrigerant recovery control unit (86) of this variation starts the refrigerant recovery control operation with the liquid side bypass valve (51) and the gas side bypass valve (53) kept closed, and thereafter, starts the valve control operation in response to satisfaction of the above-described start condition (PL<PR).

The refrigerant recovery control unit (86) of this variation may be configured to open the gas side bypass valve (53) and start adjusting the opening degree of the liquid side bypass valve (51) in response to satisfaction of the start condition (PL<PR) in the valve control operation.

Further, the refrigerant recovery control unit (86) of this variation may be configured to start adjusting the opening degree of the liquid side bypass valve (51) with the gas side bypass valve (53) kept closed in response to satisfaction of the start condition (PL<PR) in the valve control operation, open the gas side bypass valve (53) in response to satisfaction of a predetermined valve opening condition thereafter, and continue adjusting the opening degree of the liquid side bypass valve (51) in this state. Examples of the valve opening condition include a condition that "even when the opening degree of the liquid side bypass valve (51) reaches a predetermined lower limit opening degree, the degree of suction superheat or discharge superheat of the compressor (41) falls below the target degree of superheat (e.g., 5° C.−1° C.)."

—Fifth Variation—

The refrigerant recovery control unit (86) of the outdoor controller (80) of each of the first to fourth embodiments may be configured to open the gas side bypass valve (53) in the valve control operation with the liquid side bypass valve (51) kept closed, and start adjusting the opening degree of the liquid side bypass valve (51) in response to satisfaction of a predetermined condition thereafter.

—Sixth Variation—

Each of the air conditioners (10) of the first to third embodiments includes the refrigerant sensor (23) provided for the indoor unit (20) that conditions the air in the indoor space, and the refrigerator (10) of the fourth embodiment includes the refrigerant sensor (23) provided for the unit cooler (25) that conditions the air in the internal space. In contrast, the refrigerant sensor (23) may be arranged outside the indoor unit (20) or the unit cooler (25). In this case, the refrigerant sensor (23) is installed in the indoor space which is air-conditioned by the air conditioner (10) or the refrigerator (10), and outputs a detection signal as a leakage signal when the concentration of the refrigerant around the refrigerant sensor (23) exceeds a predetermined reference concentration.

—Seventh Variation—

The air conditioners (10) of the first to third embodiments and the refrigerator (10) of the fourth embodiment may have no refrigerant sensor (23). The outdoor controllers (80) of the first to fourth embodiments are configured to be able to receive the detection signal from the refrigerant sensor (23). When the air conditioner (10) or refrigerator (10) of this variation is installed in a building or the like, a refrigerant sensor (23) prepared separately from the air conditioner (10) or the refrigerator (10) is arranged at an appropriate place in the indoor space, and is connected to the air conditioner (10) or the refrigerator (10).

INDUSTRIAL APPLICABILITY

As can be seen from the foregoing description, the present invention is useful for a refrigeration apparatus that circulates a refrigerant in a refrigerant circuit to perform a refrigeration cycle.

DESCRIPTION OF REFERENCE CHARACTERS

10 Air Conditioner (Refrigeration Apparatus)
30 Refrigerant Circuit
40 Outdoor Circuit (Heat-Source-Side Circuit)
41 Compressor
42 Four-Way Switching Valve
43 Outdoor Heat Exchanger (Heat-Source-Side Heat Exchanger)
44 Outdoor Expansion Valve (Liquid Side Control Valve)
47 Liquid Side Pipe
48 Gas Side Pipe
50 Liquid Side Bypass Pipe
51 Liquid Side Bypass Valve
52 Gas Side Bypass Pipe
53 Gas Side Bypass Valve
55 Liquid Side Open-Close Valve (Liquid Side Control Valve)
56 Gas Side Open-Close Valve (Gas Side Control Valve)
57 Receiver (Container Member)
60 Indoor Circuit (Utilization-Side Circuit)
61 Indoor Heat Exchanger (Utilization-Side Heat Exchanger)
80 Outdoor Controller (Controller)

The invention claimed is:

1. A refrigeration apparatus, comprising:

a refrigerant circuit including a heat-source-side circuit provided with a compressor and a heat-source-side heat exchanger, and an utilization-side circuit provided with an utilization-side heat exchanger, the refrigeration apparatus being capable of executing a cooling operation of performing a refrigeration cycle in the refrigerant circuit with the heat-source-side heat exchanger serving as a radiator and the utilization-side heat exchanger serving as an evaporator, wherein the heat-source-side circuit includes a liquid side control valve provided for a liquid side pipe in which a refrigerant flows from the heat-source-side heat exchanger toward the utilization-side heat exchanger in the cooling operation, a liquid side bypass pipe that allows a portion of the liquid side pipe between the heat-source-side heat exchanger and the liquid side control valve to communicate with a suction side of the compressor, a liquid side bypass valve provided for the liquid side bypass pipe, a four-way switching valve that switches between a first state in which a discharge pipe of the compressor communicates with the heat-source-side heat exchanger and a suction pipe of the compressor communicates with the utilization-side circuit, and a second state in which the discharge pipe of the compressor communicates with the utilization-side circuit and the suction pipe of the compressor communicates with the heat-source-side heat exchanger, a discharge temperature sensor that is provided in a pipe connecting the discharge pipe of the compressor and the four-way switching valve and measures a temperature of a refrigerant discharged from the compressor, and a discharge pressure sensor that is provided in a pipe connecting the discharge pipe of the compressor and the four-way switching valve and measures a pressure of a refrigerant discharged from the compressor, the refrigeration apparatus further comprises a controller configured to execute, upon receiving a leakage signal indicating a leakage of the refrigerant from the utilization-side circuit, a refrigerant recovery control operation of actuating the compressor with the liquid side control valve closed so that the refrigerant in the utilization-side circuit is recovered in the heat-source-side circuit, and the controller is configured to execute, in the refrigerant recovery control operation, an operation of calculating a degree of discharge superheat, which is a degree of superheat of a refrigerant discharged from the compressor, by using measurement values of the discharge temperature sensor and the discharge pressure sensor, an operation of adjusting an opening degree of the liquid side bypass valve such that the calculated degree of discharge superheat is equal to or more than a predetermined value.

2. The refrigeration apparatus of claim 1, wherein the controller is configured to adjust an operating capacity of the compressor in the refrigerant recovery control operation such that the refrigerant to be sucked into the compressor has a predetermined target pressure higher than atmospheric pressure.

3. The refrigeration apparatus of claim 1, wherein the controller is configured to set the four-way switching valve to be in the first state in the refrigerant recovery control operation, and the liquid side bypass pipe is connected to a pipe that allows the four-way switching valve to communicate with the utilization-side circuit.

4. The refrigeration apparatus of claim 1, wherein the heat-source-side circuit has a container member arranged between the liquid side bypass valve and the liquid side pipe in the liquid side bypass pipe to store the refrigerant.

5. A refrigeration apparatus, comprising:

a refrigerant circuit including a heat-source-side circuit provided with a compressor and a heat-source-side heat exchanger, and an utilization-side circuit provided with an utilization-side heat exchanger, the refrigeration apparatus being capable of executing a cooling operation of performing a refrigeration cycle in the refrigerant circuit with the heat-source-side heat exchanger serving as a radiator and the utilization-side heat exchanger serving as an evaporator, wherein the heat-source-side circuit includes a liquid side control valve provided for a liquid side pipe in which a refrigerant flows from the heat-source-side heat exchanger toward the utilization-side heat exchanger in the cooling operation, a liquid side bypass pipe that allows a portion of the liquid side pipe between the heat-source-side heat exchanger and the liquid side control valve to communicate with a suction side of the compressor, and a liquid side bypass valve provided for the liquid side bypass pipe, the refrigeration apparatus further comprises a controller configured to execute, upon receiving a leakage signal indicating a leakage of the refrigerant from the utilization-side circuit, a refrigerant recovery control operation of actuating the compressor with the liquid side control valve closed so that the refrigerant in the utilization-side circuit is recovered in the heat-source-side circuit, the controller is configured to execute a valve control operation of opening the liquid side bypass valve in the refrigerant recovery control operation, the heat-source-side circuit including a gas side bypass pipe that allows a discharge side of the compressor to communicate with the suction side of the compressor, and a gas side bypass valve provided for the gas side bypass pipe, and switching between an open state where the refrigerant flows and a closed state where the flow of the refrigerant is blocked, and in the refrigerant recovery control operation, the controller is configured to execute, as the valve control operation, an operation of opening both the liquid side bypass valve and the gas side bypass valve.

6. The refrigeration apparatus of claim 5, wherein the controller is configured to execute, as the valve control operation, an operation of adjusting an opening degree of the liquid side bypass valve such that the refrigerant to be sucked into the compressor is in a gas single-phase state.

7. The refrigeration apparatus of claim 5, wherein the liquid side bypass valve is a valve whose opening degree in an open state is variable, the gas side bypass valve is a valve whose opening degree in an open state is fixed, and the controller is configured to execute, as the valve control operation, an operation of adjusting the opening degree of the liquid side bypass valve such that the refrigerant to be sucked into the compressor is in a gas single-phase state, and an operation of opening the gas side bypass valve.

8. The refrigeration apparatus of claim 5, wherein the liquid side bypass valve is a valve whose opening degree in an open state is variable, the gas side bypass valve is a valve whose opening degree in an open state is fixed, and the controller is configured to execute, as the valve control operation, an operation of adjusting an opening degree of the liquid side bypass valve such that the refrigerant discharged from the compressor has a degree of superheat equal to or more than a predetermined value, and an operation of opening the gas side bypass valve.

9. The refrigeration apparatus of claim 5, wherein the heat-source-side circuit has a four-way switching valve that switches between a first state in which a discharge side of the compressor communicates with the heat-source-side heat exchanger and a suction side of the compressor communicates with the utilization-side circuit, and a second state in which the discharge side of the compressor communicates with the utilization-side circuit and the suction side of the compressor communicates with the heat-source-side heat exchanger, the controller is configured to set the four-way switching valve to be in the first state in the refrigerant recovery control operation, and the liquid side bypass pipe is connected to a pipe that allows the four-way switching valve to communicate with the utilization-side circuit.

10. A refrigeration apparatus, comprising:

a refrigerant circuit including a heat-source-side circuit provided with a compressor and a heat-source-side heat exchanger, and an utilization-side circuit provided with an utilization-side heat exchanger, the refrigeration apparatus being capable of executing a cooling operation of performing a refrigeration cycle in the refrigerant circuit with the heat-source-side heat exchanger serving as a radiator and the utilization-side heat exchanger serving as an evaporator, wherein the heat-source-side circuit includes a liquid side control valve provided for a liquid side pipe in which a refrigerant flows from the heat-source-side heat exchanger toward the utilization-side heat exchanger in the cooling operation, a liquid side bypass pipe that allows a portion of the liquid side pipe between the heat-source-side heat exchanger and the liquid side control valve to communicate with a suction side of the compressor, and a liquid side bypass valve provided for the liquid side bypass pipe, the refrigeration apparatus further comprises a controller configured to execute, upon receiving a leakage signal indicating a leakage of the refrigerant from the utilization-side circuit, a refrigerant recovery control operation of actuating the compressor with the liquid side control valve closed so that the refrigerant in the utilization-side circuit is recovered in the heat-source-side circuit, the controller is configured to execute a valve control operation of opening the liquid side bypass valve in the refrigerant recovery control operation, the heat-source-side circuit has a gas side control valve provided for a pipe in which the refrigerant flows from the utilization-side circuit toward the compressor in the cooling operation, and the controller is configured to close the gas side control valve and stop the compressor in response to satisfaction of a condition for terminating the refrigerant recovery control operation.

* * * * *